US012612229B2

(12) United States Patent
Drake, Jr.

(10) Patent No.: US 12,612,229 B2
(45) Date of Patent: Apr. 28, 2026

(54) CABLE TIE FINGER MANIPULATION STRUCTURE

(71) Applicant: Eldon L. Drake, Jr., Broken Arrow, OK (US)

(72) Inventor: Eldon L. Drake, Jr., Broken Arrow, OK (US)

(73) Assignee: ELDrake Manufacturing, LLC, Tulsa, OK (US)

( * ) Notice: Subject to any disclaimer, the term of this patent is extended or adjusted under 35 U.S.C. 154(b) by 0 days.

(21) Appl. No.: 19/208,691

(22) Filed: May 15, 2025

(65) Prior Publication Data

US 2025/0353649 A1 Nov. 20, 2025

Related U.S. Application Data

(60) Provisional application No. 63/648,922, filed on May 17, 2024.

(51) Int. Cl.
*B65D 63/10* (2006.01)
*B65B 13/02* (2006.01)

(52) U.S. Cl.
CPC ..... *B65D 63/1027* (2013.01); *B65B 13/027* (2013.01)

(58) Field of Classification Search
CPC ... B65D 63/1027; B65B 13/027; F16L 3/233; F16L 3/127
USPC ..... 248/74.3
See application file for complete search history.

(56) References Cited

U.S. PATENT DOCUMENTS 3,014,506 A * 12/1961 Crimmins ..... B65B 13/027 30/298
3,186,047 A 6/1965 Schwester et al.
3,610,296 A 10/1971 Kabel
4,272,870 A 6/1981 McCormick
4,665,588 A * 5/1987 Nakano ..... H01J 29/003 248/74.3
4,911,572 A 3/1990 Williams
5,205,328 A 4/1993 Johnson et al.
5,402,971 A * 4/1995 Bower ..... H02G 3/32 248/74.3
5,915,425 A 6/1999 Nilsson et al.
(Continued)

FOREIGN PATENT DOCUMENTS

CN 211308450 U 8/2020

*Primary Examiner* — Sarang Afzali
*Assistant Examiner* — Darrell C Ford
(74) *Attorney, Agent, or Firm* — Hall Estill Law Firm

(57) ABSTRACT

Method and apparatus for installing a cable tie about a bundle. The cable tie has a ratcheting head and a strap with a ratcheting pattern configured to engage the ratcheting head to encircle and secure a bundle. A finger engagement structure includes a ratcheting element configured to ratchetingly engage the cable tie, and a contact member configured to facilitate tightening of the cable tie and securement of the bundle to a substrate. The ratcheting element may comprise a second ratcheting head configured to engage the ratcheting pattern of the cable tie, and the contact member may comprise a selected one of a ring, a plate or a third ratcheting head. Alternatively, the ratcheting element may comprise a second strap having a second ratcheting pattern configured to engage a second ratcheting head of the cable tie, and the contact member may comprise a plate from which the second strap extends.

22 Claims, 12 Drawing Sheets

(56) References Cited

U.S. PATENT DOCUMENTS

| | | | | |
|---|---|---|---|---|
| 6,032,680 | A | 3/2000 | Lu et al. | |
| 7,360,562 | B1 * | 4/2008 | Hindmarsh | B65B 13/027 140/93.2 |
| 8,276,244 | B2 | 10/2012 | Vermeer et al. | |
| 8,732,914 | B2 | 5/2014 | Browne et al. | |
| 8,739,387 | B1 | 6/2014 | Frishberg | |
| 9,038,246 | B2 | 5/2015 | Liang | |
| 9,151,411 | B2 | 10/2015 | Owen | |
| 9,445,178 | B2 | 9/2016 | Rothbaum et al. | |
| 9,555,943 | B2 | 1/2017 | Breen, IV et al. | |
| 9,694,924 | B2 | 7/2017 | Myers et al. | |
| 10,053,268 | B1 * | 8/2018 | Sickenberger | B65D 63/18 |
| 11,485,528 | B2 | 11/2022 | Dohrmann et al. | |
| 11,603,241 | B2 | 3/2023 | McDowell, III | |
| 11,643,231 | B2 | 5/2023 | Xu | |
| 2014/0290015 | A1 | 10/2014 | Barron | |
| 2016/0244228 | A1 * | 8/2016 | Montejo | B65D 63/1063 |
| 2018/0244447 | A1 * | 8/2018 | Chmelar | B65D 63/1027 |
| 2019/0119018 | A1 * | 4/2019 | Chmelar | B65D 63/1072 |
| 2019/0170272 | A1 * | 6/2019 | Sims | F16L 3/137 |
| 2019/0218006 | A1 | 7/2019 | Matz | |
| 2020/0137906 | A9 | 4/2020 | Mayfield | |

* cited by examiner

CABLE TIE FINGER MANIPULATION STRUCTURE

RELATED APPLICATIONS

The present application makes a claim of domestic priority under 35 U.S.C. 119(e) to U.S. Provisional Patent Application No. 63/648,922 filed May 17, 2024, the contents of which are hereby incorporated by reference.

BACKGROUND

Cable ties are a popular type of banded strapping mechanism for securing a group of elements together, such as a bundle of electrical cables or the like. A conventional cable tie, or "zip tie," usually comprises a one-piece connector with an elongated flexible strap, a ratcheting head at a first end, and a tail at an opposing second end. A serration pattern is provided along one side of the strap.

The tail is adapted to be inserted into the head, and a deflectable pawl within the head lockingly engages the serrations as the strap is pulled through the head and the strap is tightened. Tension applied to the strap in an opposite direction acts to pivot the pawl and prevent withdrawal of the strap from the head portion.

Once installed, the protruding end of the strap can be trimmed to provide a neat and compact strap installation. As such, cable ties are effective and efficient one-way securement mechanisms that permit tightening in one direction but resist loosening in the opposite direction. The cable ties can be formed of any number of suitable flexible materials such as a synthetic polymer, a metal, etc.

While operable, these and other forms of cable ties can be difficult to manipulate, feed and tighten around a bundle, particularly in close quarters where space and visibility are limited. While a number of tools have been proposed to facilitate cable tie installation operations, there remains a need for continued improvements in this area, including solutions that allow manual installation of such ties in an efficient and precise manner.

SUMMARY

Various embodiments are generally directed to systems and methods for securing a bundle using a novel cable tie configuration.

In some embodiments, an apparatus includes a cable tie with a ratcheting head and a strap having a ratcheting pattern configured to engage the ratcheting head to encircle and secure a bundle. A finger engagement structure includes a ratcheting element configured to ratchetingly engage the cable tie, and a contact member configured to facilitate tightening of the cable tie and securement of the bundle to a substrate.

The ratcheting element may comprise a second ratcheting head nominally identical to the ratcheting head of the cable tie and configured to engage the ratcheting pattern of the cable tie, and the contact member may comprise a selected one of a ring, a plate or a third ratcheting head. Alternatively, the ratcheting element may comprise a second strap having a second ratcheting pattern configured to engage a second ratcheting head of the cable tie, and the contact member may comprise a plate from which the second strap extends.

In related embodiments, a cable tie assembly is provided with a cable tie and a moveable engagement member used to tighten the cable tie. The cable tie has an elongated, flexible strap with a ratcheting head at a first end, a tip at an opposing second end, and a ratcheting pattern along an innermost side of the strap. The tip is configured for insertion into the ratcheting head for one-way ratcheted advancement of the ratcheting pattern therethrough. The moveable engagement member is affixed to the strap adjacent the tip, and is configured to contactingly engage a digit of a hand of the user to guide the tip into the ratchet head and, through repetitive one-way ratcheted advancement of the ratcheting pattern therethrough, tighten the strap around a bundle.

In further related embodiments, a method is provided for securing a cable tie about a bundle, the cable tie having a strap with a ratcheting pattern and a cable tie ratcheting head. Steps include inserting a tip of the strap into a ratcheting head of a finger engagement structure to engage the ratcheting pattern of the strap; inserting the tip of the strap into the cable tie ratcheting head; and using a finger of a user to repetitively advance and retract the finger engagement structure relative to the cable tie ratcheting head to advance the strap through the cable tie ratcheting head.

These and other features and advantages of various embodiments can be understood from a review of the following detailed description in conjunction with a review of the accompanying drawings.

DETAILED DISCUSSION

Figure 1A:
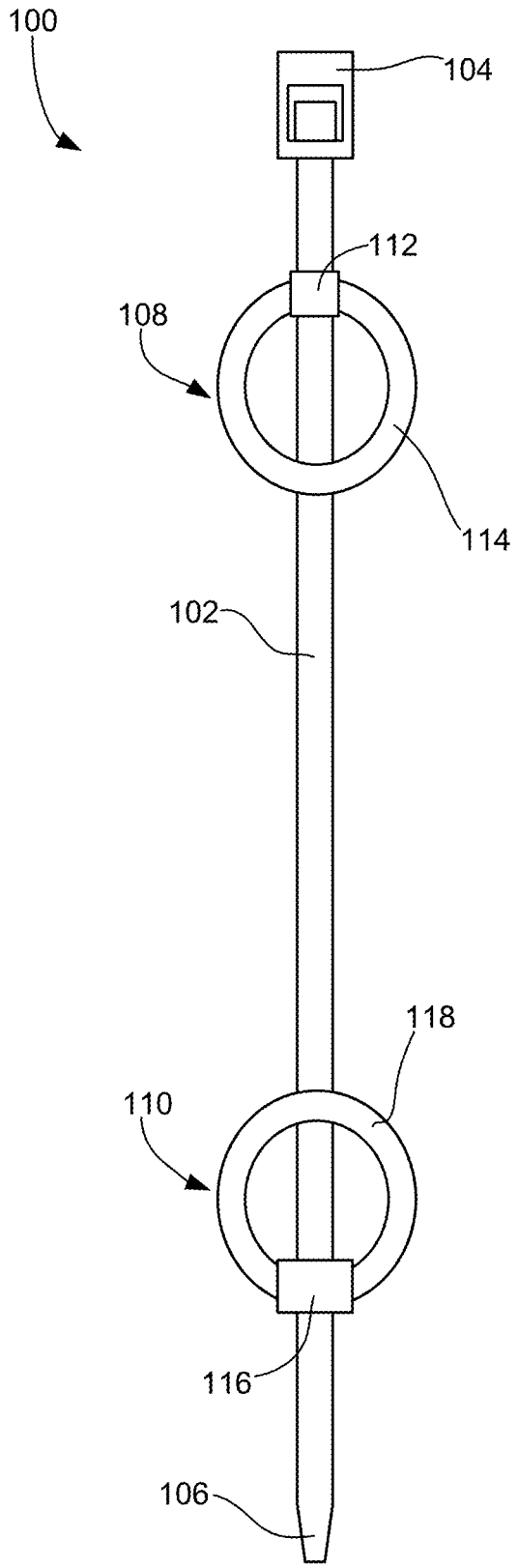
FIGS. 1A and 1B provide top and side elevational depictions of a cable tie installation assembly constructed and operated in accordance with some embodiments of the present disclosure.

Embodiments of the present disclosure provide systems and methods for effective and efficient cable tie installation and securement.

As explained below, some embodiments are directed to a self-contained cable tie installation assembly adapted to facilitate one-handed installation and tightening of a cable tie strap about a bundle. The cable tie may be a conventional cable tie, or may be a specially configured cable tie with built-in features to expedite the installation process.

The cable tie installation assembly includes one or more novel finger engagement (ring) structures that are provided for engagement by digits of a hand of the user to facilitate installation of the cable tie. A guide can be additionally provided to aid the user in feeding the tail into the head.

In some embodiments, a pair of finger engagement structures are provided that cooperate to facilitate installation of the cable tie. A thumb ring structure is positioned adjacent the head of the cable tie, and a forefinger ring structure is positioned adjacent the tip portion of the cable tie strap. The thumb ring structure allows the user to hold the head in a desired stationary location while the user uses the forefinger ring structure to advance the tip into and through the head.

The forefinger ring structure includes a ratcheting element in the form of a ratchet head that engages the ratchet pattern of the cable tie. This allows the user to retract and extend the forefinger to successively advance the strap through the head to tighten the cable tie. The thumb ring structure can also include a ratchet head for advancement along the ratchet pattern of the cable tie to a position adjacent the head, or can be incorporated into the design of the cable tie.

Once fully tightened, the user removes the thumb and forefinger from the respective rings. The rings can remain in place or be trimmed from the cable tie. In other embodiments, the rings are configured to be removed from the cable tie once installation is completed for reuse on a new cable tie.

Both the thumb ring structure and the forefinger ring structure may be provided with a head portion that is nominally identical to the primary head on the cable tie. In this way, the thumb ring structure can be fed onto the band in the same direction as the primary head so that the thumb ring is "zipped" along the full length of the band to a position adjacent the primary head. The forefinger ring structure is next fed onto the tip of the band and incrementally advanced as before. From a manufacturing standpoint, this configuration is particularly useful since the two finger ring structures can be provided for use with an otherwise conventional cable tie, and can be nominally identical. Each ring structure can be provided with an engagement surface, such as but not limited to a depression pad surface, to facilitate extension and/or retraction of the associated ring structure.

In further embodiments, the head portion in each ring structure is open to the side to facilitate lateral insertion of the head onto the strap and subsequent removal of the head from the strap. This allows a set of ring structures to be placed onto a cable tie for installation, after which the ring structures can be removed for re-use on a new, subsequent cable tie. Any number of other engagement and disengagement configurations can be used including clips, living hinges, snaps, etc.

Other embodiments provide a specially configured cable tie with an integrated thumb ring portion that extends from the top or side of the cable tie, allowing a single forefinger ring portion to be used to tighten the cable tie. Still other embodiments provide a finger engagement structure with an adhesive layer, allowing a secured bundle to be tightened and then adhered to a mounting surface. Other embodiments include multi-headed cable ties, finger engagement structures that utilize ratchet patterns, metal cable ties, cable ties formed of memory metal, a glove with integrated finger engagement structures, and so on.

Figure 1B:
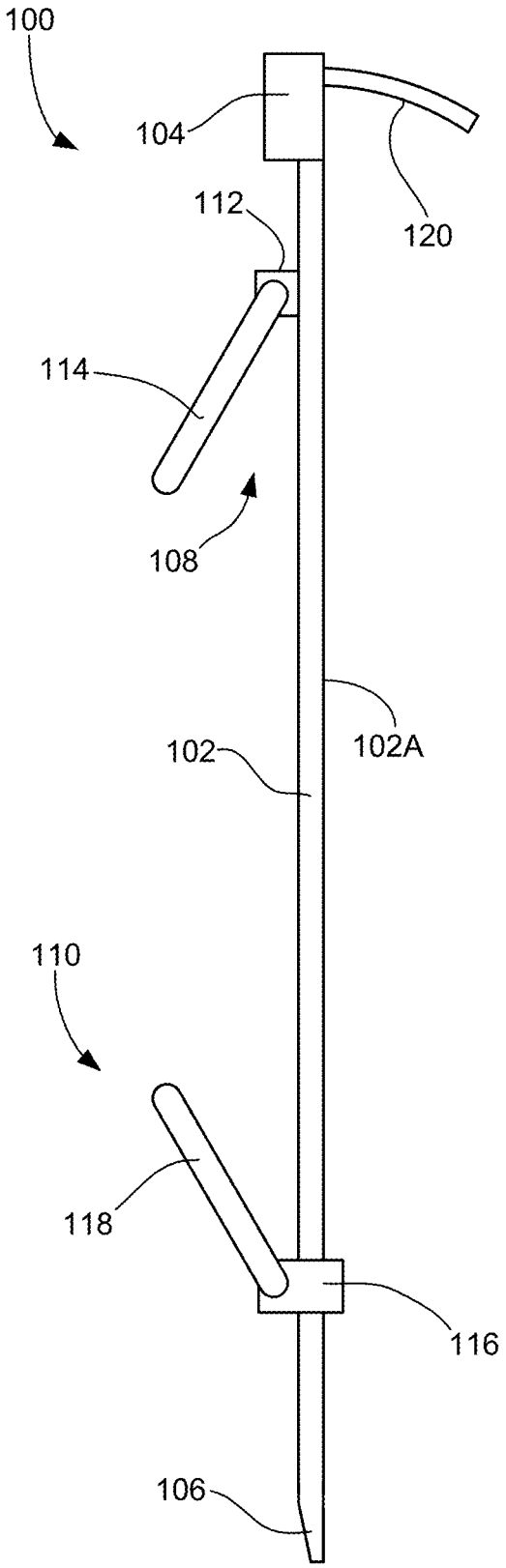

These and other features and advantages of various embodiments can be understood beginning with a review of FIGS. 1A and 1B, which provide respective top and side elevational views of a cable tie installation assembly 100 in accordance with a first of several embodiments. It will be appreciated that all of the drawings presented herein are schematic in nature, and may not be necessarily drawn to scale. Like reference numerals are used to identify similar components among the various embodiments.

The cable tie installation assembly 100 has an elongated strap (band) 102 bounded at opposing ends by a ratcheting head portion 104 (head) and a flexible tail portion 106 (tail). A ratcheting pattern, not separately shown in FIGS. 1A-1B, will be understood to extend along an underside surface 102A of the strap 102.

For purposes herein, a head portion such as 104 and a ratcheting pattern such as the pattern provided on strap 102 are each sometimes referred to herein as respective "ratcheting elements," in that these contribute to a ratcheting operation whereby the strap member is advanced in a first direction and nominally prevented from retracting in in opposing second direction. The head facilitates the ratcheting operation from the use of an internal deflectable pawl or similar member. The pattern facilitates the ratcheting operation from the use of discontinuous shoulder surfaces that mechanically interfere with the movement of the pawl.

The assembly 100 incorporates a pair of finger engagement structures in the form of a stationary first ring structure 108 and a moveable second ring structure 110. The first ring structure 108 is secured to the strap 102 at a first location adjacent the head 104, and the second ring structure 110 engages the strap 102 at a second location adjacent the tail 106. The first ring structure 108 includes a base 112 from which extends an annular first flexible ring 114 adapted to contactingly receive a tip of a first digit of a user (in this case, a thumb of the user).

The second ring structure 110 similarly includes a base 116 from which extends an annular second flexible ring 118 adapted to contactingly receive a tip of a second digit of the user (in this case, a forefinger of the user). While not limiting, it is contemplated that the size and spacing of the respective ring structures 108, 110 are selected to enable the user to manipulate the cable tie using the thumb and forefinger from the same hand around a relatively small bundle.

Figure 1C:
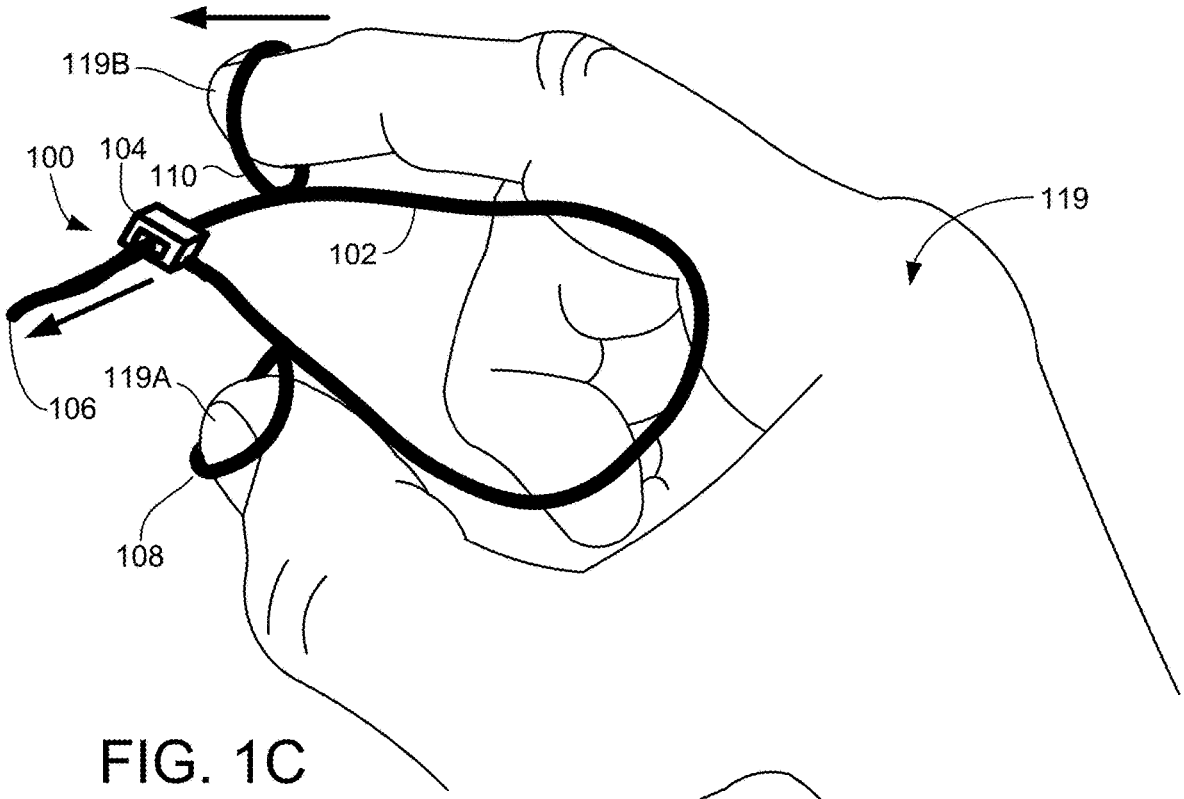
FIGS. 1C and 1D show user manipulation of the cable tie installation assembly of FIGS. 1A and 1B in accordance with some embodiments.
Figure 1D:
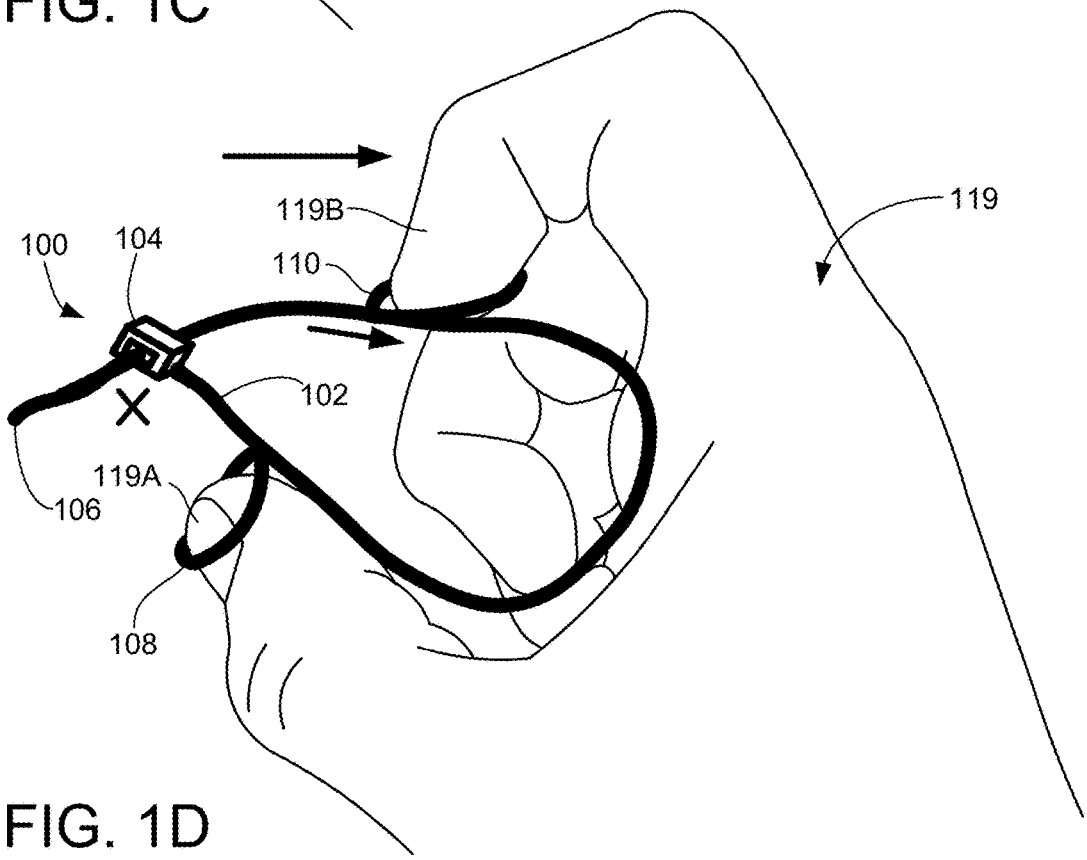

This arrangement is shown more fully in FIGS. 1C and 1D, where a hand 119 of the user is shown in conjunction with the assembly 100. A thumb 119A of the user's hand 119 engages the first ring structure 108, and a forefinger 119B of the user's hand 119 engages the second ring structure 110.

FIG. 1C depicts extension of the forefinger 119B to advance the strap 102 through the head 104. FIG. 1D depicts retraction of the forefinger 119B as the second ring structure 110 is retracted along the strap 102. It will be noted that both the ring structure 110 and the strap 102 are moved forward in FIG. 1C, and that the strap 102 remains stationary while the ring structure 110 is pulled back along the strap in FIG. 1D. The thumb 119A, by way of the first ring structure 108, maintains the head 104 in a desired stationary orientation during both of these extension and retraction operations.

While the assembly 100 is particularly suited to one-handed installation as shown in FIGS. 1C-1D, other sizes and spacings can be used so that this particular configuration is merely exemplary and is not limiting. For example, a user may elect to use one digit from a first hand to engage a first ring structure (e.g., structure 108) and to use another digit from a second hand to engage a second ring structure (e.g., structure 110). Other configurations will readily occur to the skilled artisan.

Returning to FIGS. 1A-1B, an optional guide portion 120 extends from the head 104, as best viewed in FIG. 1B. The guide portion 120 is used to guide the tip 106 into the head 104, particularly in applications where the bundle being secured obstructs the ability of the user to view these elements during engagement. The assembly 100 can be formed of any number of suitable flexible materials, such as but not limited to nylon.

Figure 2:
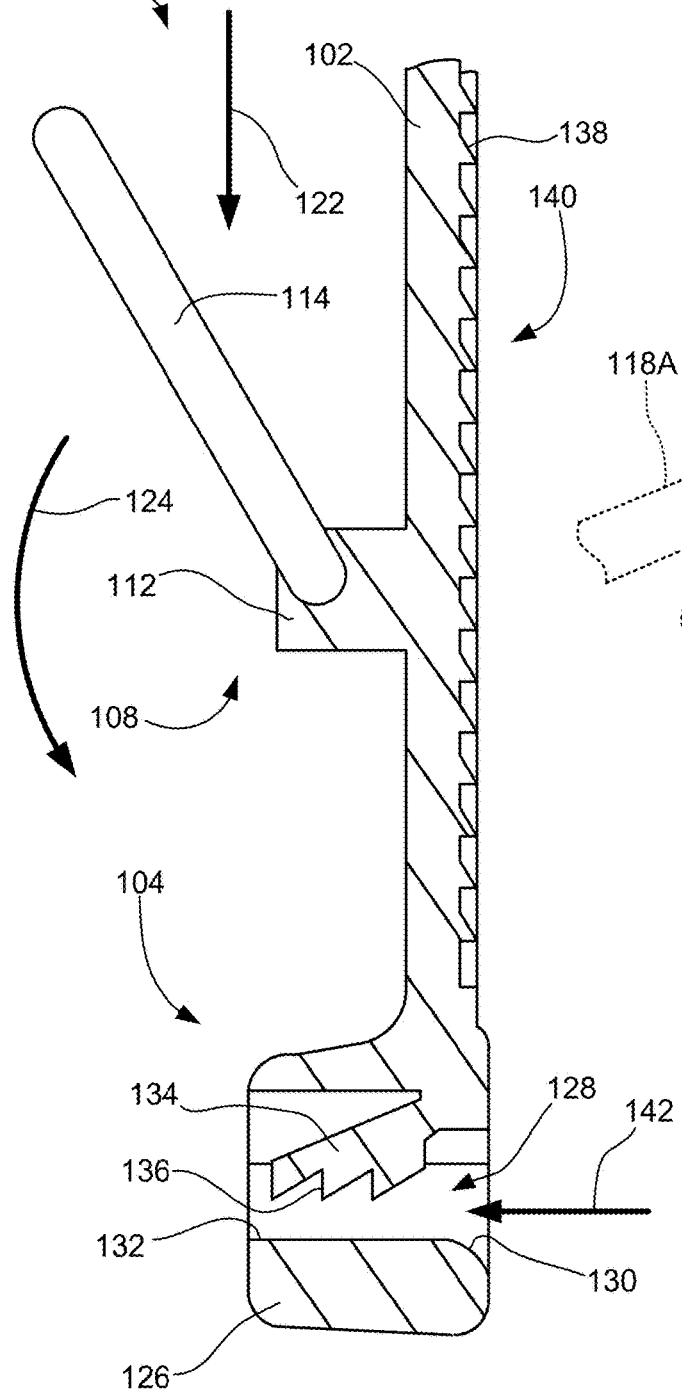
FIG. 2 is an elevational, cross-sectional view of a head portion and a thumb ring structure of the cable tie assembly in some embodiments.

FIG. 2 shows aspects of the cable tie installation assembly 100 from FIGS. 1A-1D in greater detail. In this embodiment, the thumb ring structure 108 is securely affixed to the band 102 so that the base 112 is integrated into, and extends from, the strap material. Other configurations can be used.

The thumb ring 114 can be affixed in a stationary relation to the base 112 at a desired angle such as about 45 degrees from the strap 102. The ring 114 is deflectable so that the user can insert and guide the thumb into the ring along direction 122 to engage the ring as shown in FIGS. 1C-1D. A resulting biasing force supplied by the ring 114 as the ring is deflected out of its normal position will help retain the engagement of the tip of the thumb within the ring. Other configurations and orientations are contemplated, however, including an alternative embodiment where the ring 112 is configured to freely rotate through the base 112 along arcuate path 124.

The head 104 in FIG. 2 includes a body portion 126 with an insertion channel (passageway) 128 extending therethrough bounded by an inlet 130 and an outlet 132. A deflectable pawl 134 with one or more laterally extending teeth (pattern engagement surfaces) 136 projects into the channel 128.

The strap 102 includes engagement teeth (pawl engagement surfaces) 138 that extend along a ratcheting (serration) pattern 140 of the strap. To secure the cable tie, the flexible strap 102 is wrapped around a bundle (not separately shown), and the tip 106 is inserted into the inlet 130 along insertion direction 142. Continued advancement of the strap 138 causes ratcheting engagement of the teeth 138 with the teeth 136 of the pawl 134 to tighten the strap in a one-way engagement arrangement. The serration pattern 140 of the strap 102 faces inwardly toward the secured bundle.

Figure 3A:
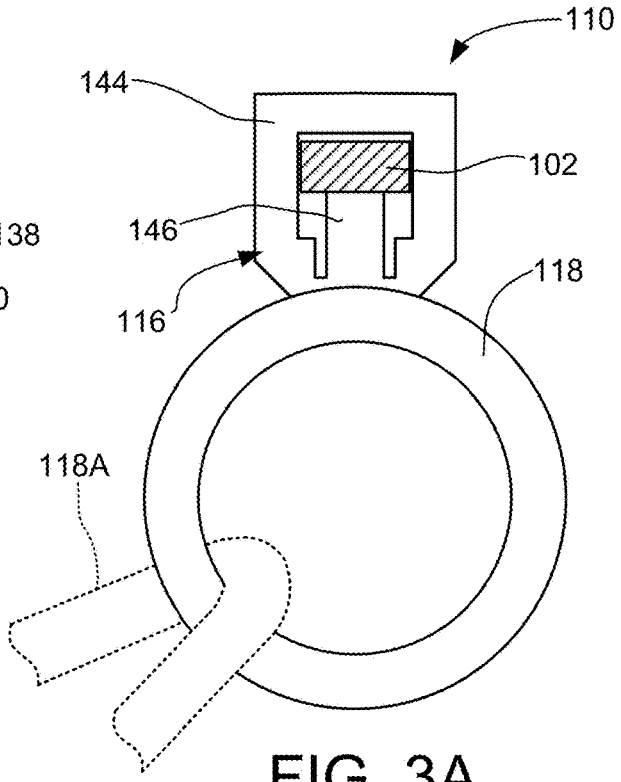
FIGS. 3A and 3B illustrate a forefinger ring structure of the cable tie assembly in some embodiments.

FIG. 3A shows a top plan view of the second (forefinger) ring structure 110 from FIGS. 1A-1D in further embodiments. In this case, the base 116 incorporates a ratcheting element in the form of a head portion 144. The head portion 144 is nominally identical to the head portion 104 of the cable tie 100, and includes a deflectable pawl 146 with one or more teeth (see 136, FIG. 2) that engage the ratcheting pattern strap 102 as before.

Figure 3B:
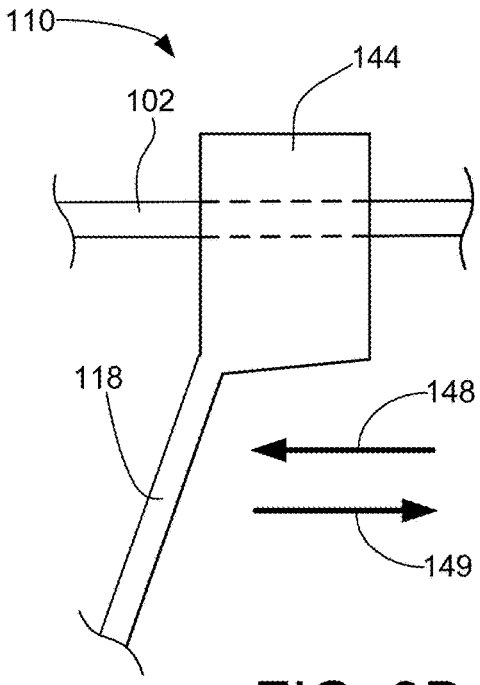

Both heads 104 and 144 are oriented in the same operative direction to respectively receive the tip 106 of the head 102 for one-way advancement of the strap relative to the respective head. For reference, the head 104 is sometimes referred to herein as a first or primary head, and the head 144 is sometimes referred to herein as a second or secondary head. FIG. 3B shows a side elevational depiction of the structure in FIG. 3A. The strap 102 is advanced through the head 144 in direction 148, and the head 144 interlocks the strap 102 in direction 149.

The structure 110 in FIG. 3A operates in a manner similar to a conventional cable tie to advance along a length of a strap. Other shapes and configurations can be used apart from the ring 118 shown in FIG. 3A to provide a finger engagement surface for the user's digit. Examples include but are not limited to a hook shaped member, a solid member with a concave or other shaped surface, an oval or rectilinearly shaped member, a projection, side edges to facilitate grasping by multiple finger surfaces, etc.

While the ring structure 110 is configured to facilitate tightening of the cable tie, it will be appreciated that the structure additionally or alternatively provides a convenient attachment point to secure the bundle at a desired mounting location once the cable tie has been installed. For example, a cord, strap, wire, second cable tie, etc. can be passed through the ring 118 in FIG. 3A, as generally represented by attachment mechanism 118A to secure the bundle to a substrate or other mounting surface. For particularly heavy loads, the ring structure 110 can be reinforced to withstand significant forces that equal or exceed the tensile strength of the secured cable tie.

Figure 4:
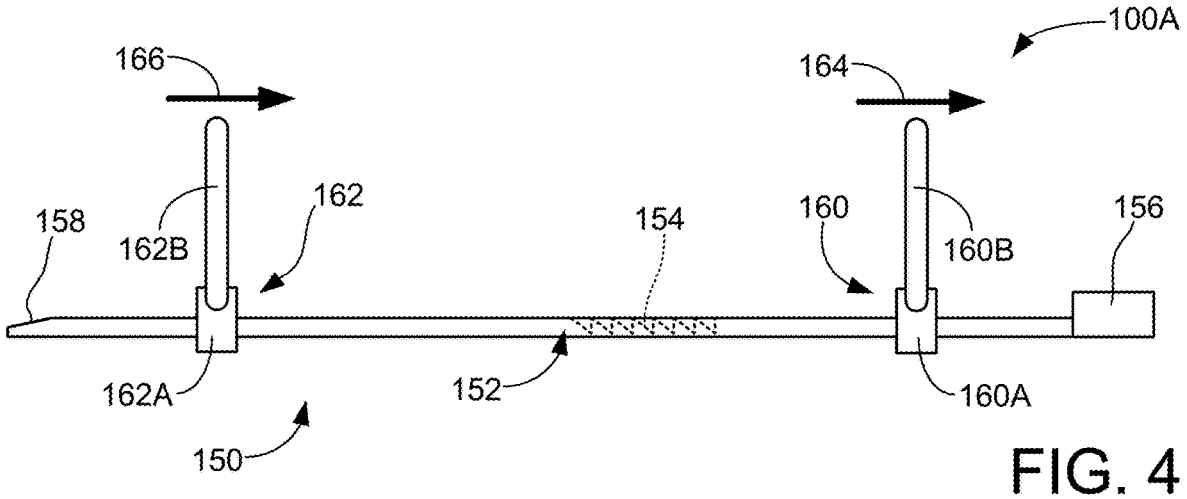
FIG. 4 shows another cable tie assembly in accordance with further embodiments.

FIG. 4 shows another cable tie assembly 100A similar to the cable tie assembly 100 discussed above. In this case, a conventional cable tie 150 is supplied having a strap portion 152 with a recessed serration pattern 154, a head 156 and a tip 158. A pair of moveable ring structures 160, 162 are fed onto and engage the serration pattern 154. The ring structures 160, 162 are nominally identical and have respective head 160A, 162A and ring 160B, 162B portions. The head portions 160A, 162A serve as ratcheting elements that operate in cooperation with the strap ratcheting pattern 154.

In this embodiment, the ring structure 160 is inserted first onto the strap portion 152 and zipped to the end of the pattern 154 to a position adjacent the head 156 to serve as a thumb ring. The ring structure 162 is subsequently placed onto the strap portion 152 and is advanced and retracted as required, thereby serving as a forefinger ring. While two ring structures are shown, other numbers, combinations and configurations of ring structures can be utilized including a single structure, more than two structures, etc.

Figure 5:
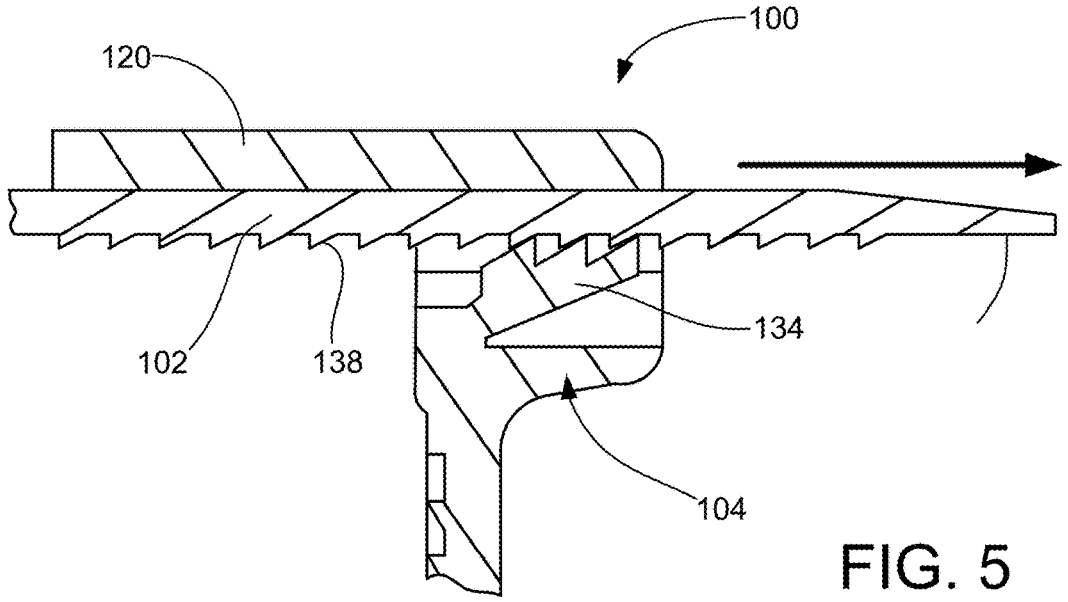
FIG. 5 illustrates aspects of a guide portion of another cable tie assembly in accordance with further embodiments.

FIG. 5 shows further aspects of the guide portion 120 of the cable tie assembly 100 in further embodiments. The guide portion 120 extends from the body of the head 104 to facilitate passage of the tip 106 into and through the head. This can be useful in applications where the bundle being secured obstructs the user's ability to observe the threading operation.

Figure 6A:
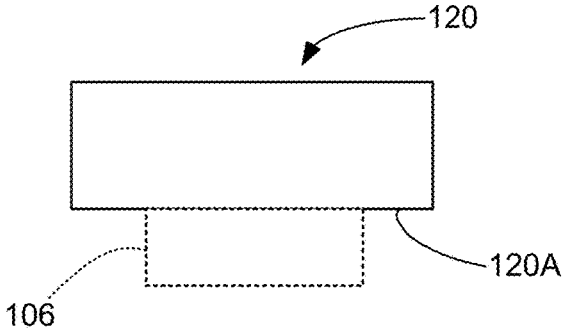
FIGS. 6A and 6B show alternative configurations for the guide portion of FIG. 5 in further embodiments.
Figure 6B:
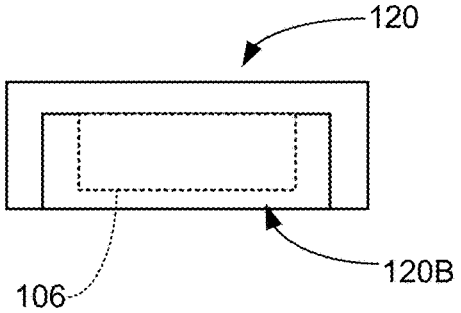

FIGS. 6A and 6B show different configurations for the guide portion 120 from FIG. 5 in some embodiments. A solid block configuration is illustrated in FIG. 6A so that the guide 120 has a flat contact surface 120A. The surface 120A allows the user, by tactile inputs (e.g., "by feel"), to place the tip 106 into this surface and advance the tip through the head 104. A channel configuration is illustrated in FIG. 6B. In this case, a u-shaped channel 120B allows the user to guide the tip 106 into the head 104.

Other guide configurations can be used. When an otherwise conventional cable tie is used such as the conventional cable tie 150 in FIG. 4, the guide 120 can be clipped onto or otherwise temporarily attached to the head 156.

Figure 7A:
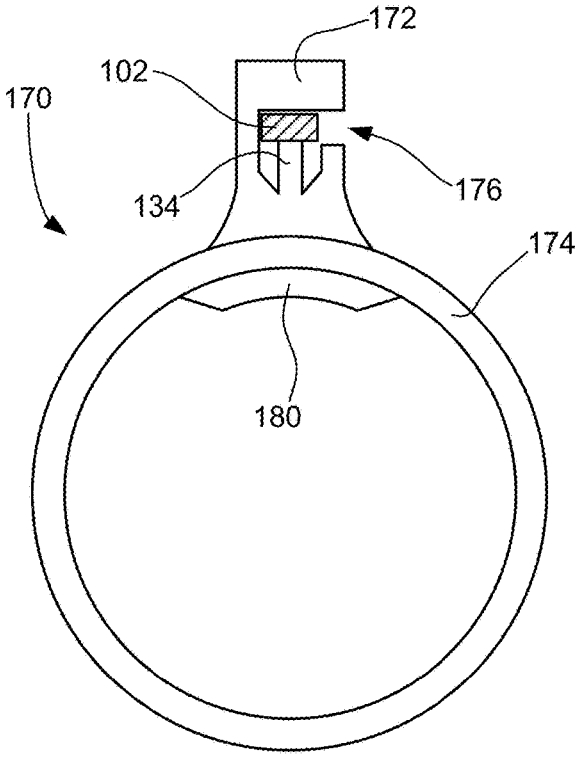
FIGS. 7A through 7D show various views of another finger structure in accordance with further embodiments.
Figure 7B:
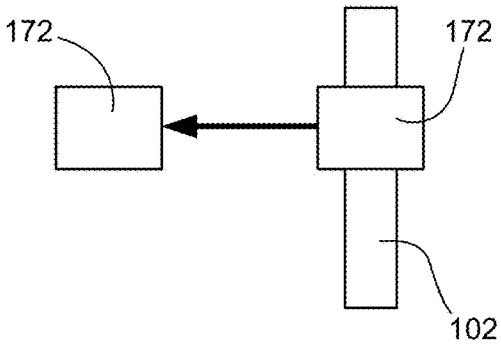
Figure 7C:
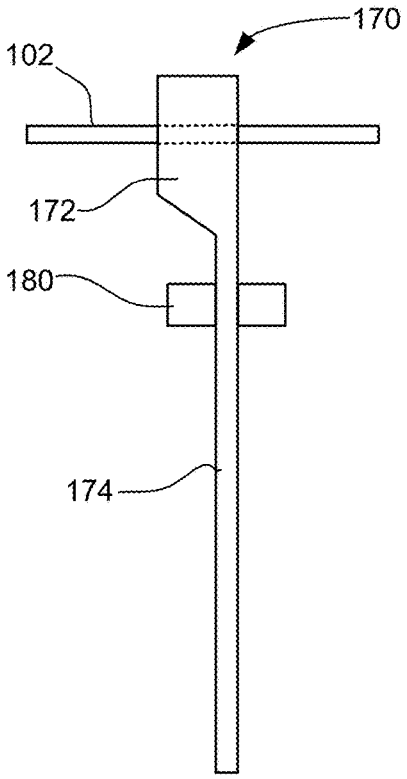
Figure 7D:
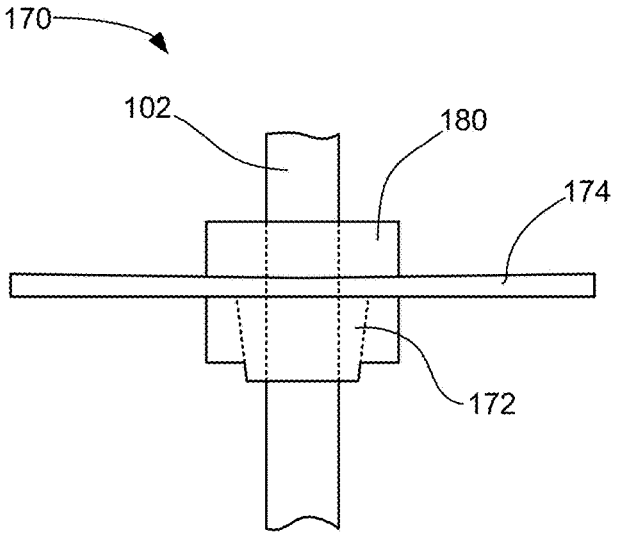

FIGS. 7A through 7D show additional embodiments for a ring structure 170 in accordance with further embodiments. The ring structure 170 is similar to those described above. The structure 170 includes a head 172 and a ring 174. The head 172 in FIG. 7A serves as a ratcheting element to engage the ratcheting pattern of a cable tie as before. However, the head 172 is open on one side, as shown by opening 176. This allows the ring structure 170 to be laterally removed from the strap 102, as shown in FIG. 7B, once the installation operation is completed.

The structure 170 further includes a depression pad 180, which is located at a base portion of the ring 174. As further shown in FIGS. 7C and 7D, the pad 180 can be variously sized and shaped to provide a finger control surface for the tip of the digit (e.g., thumb 119A, forefinger 119B, etc.) to maintain engagement with the structure 170.

Figure 8A:
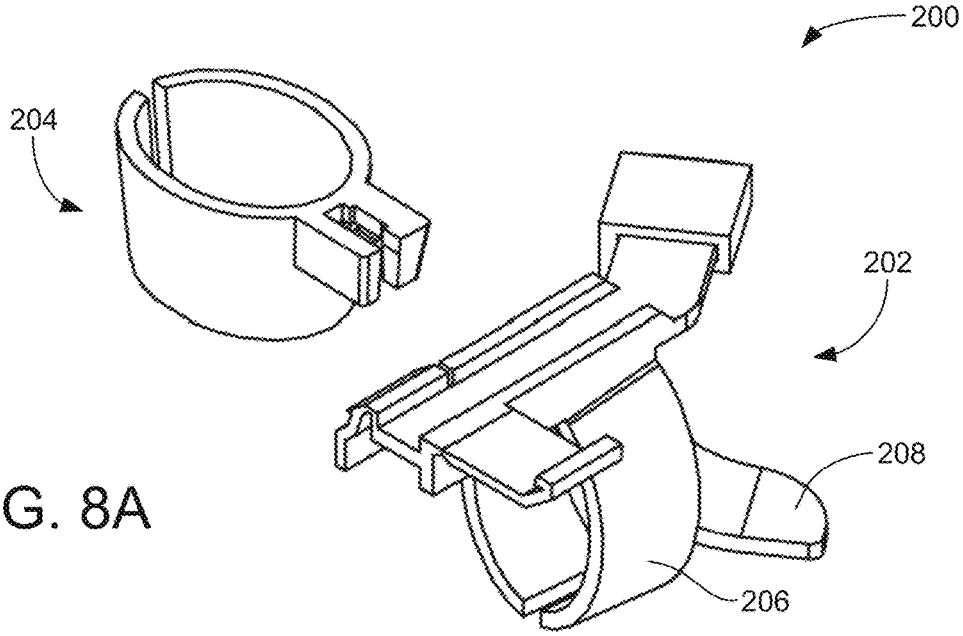
FIG. 8A provides an isometric view of another cable tie installation assembly in accordance with further embodiments of the present disclosure.
Figure 8B:
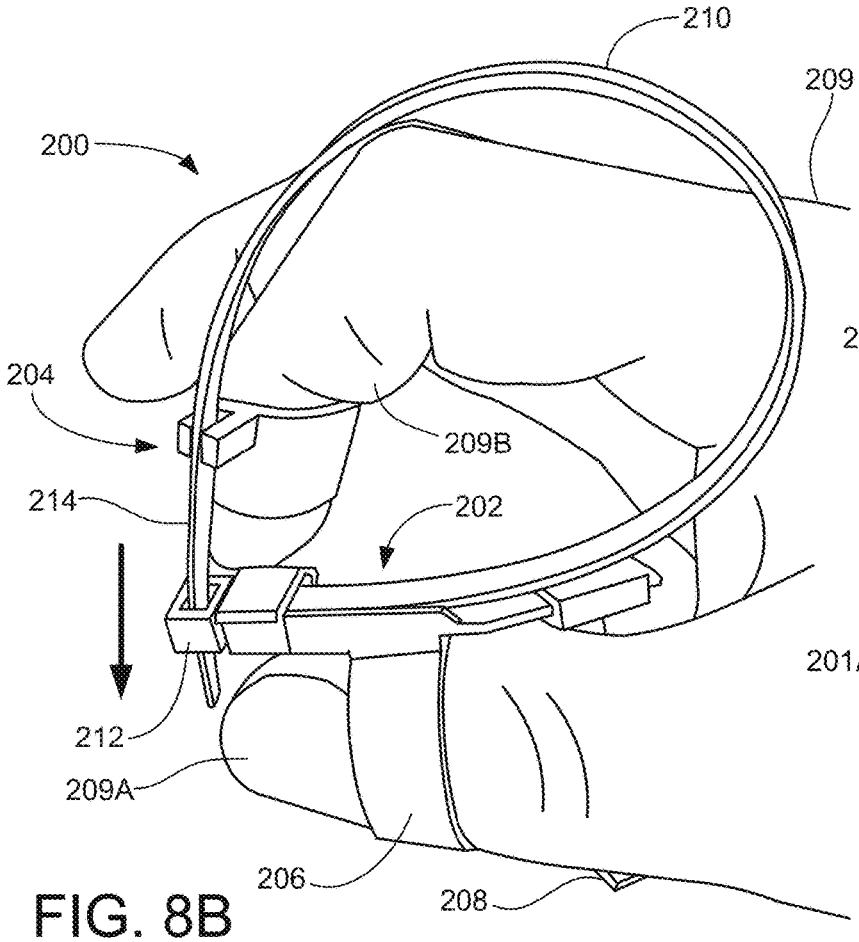
FIG. 8B shows user manipulation of the cable tie installation assembly of FIG. 8A to install a conventional cable tie.

FIGS. 8A and 8B show another cable tie installation assembly 200 in accordance with further embodiments. The assembly 200 is similar to the embodiments described above and includes first and second finger engagement structures 202, 204 adapted to respectively engage a thumb 209A and a finger 209B of a user 209.

The first finger engagement structure 202 includes a base portion 206 sometimes referred to as a thumb tool. An adjustable guide 208, sometimes referred to as a thumb adjuster, attaches to the thumb tool 206 to provide additional support to the user's thumb. The second finger engagement structure 204 is sometimes referred to as a finger tool.

The user 209 uses the assembly 200 to install a cable tie 210 as shown in FIG. 8B. As before, the thumb tool 206 is used to support a head 212 of the cable tie 210, and the finger tool 204 is used to guide and repetitively advance a strap portion 214 of the cable tie through the head 212 to tighten the strap.

Figure 8C:
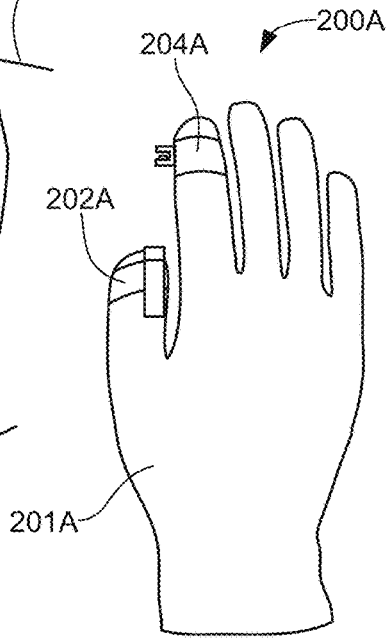
FIG. 8C shows a glove-based cable tie installation assembly similar to the assembly of FIGS. 8A-8B.

At this point, it will be noted that the finger engagement structures 202, 204 may be worn directly by the user as shown in FIG. 8B, or may be incorporated into a glove that is worn on the hand of the user, as shown in FIG. 8C. More particularly, FIG. 8C shows a cable tie installation assembly 200A that incorporates a work glove 201A having integrated first and second engagement structures 202A, 204A.

The structures 202A, 204A operate in a manner similar to the assembly 200 in FIG. 8B to ratchetingly engage the cable tie to facilitate tightening of the cable tie. It is contemplated that the respective structures 202A, 204A will be configured with features such as gaps and latching mechanisms to allow disengagement of the glove 201A from the cable tie 210, as with the assembly 200 in FIG. 8B.

In an alternative embodiment, at least the finger engagement structure 204 on the index finger of the glove 201A can be made detachable from the glove, allowing the ring structure to remain on the cable tie, thereby allowing securement of the bundle to a substrate after the bundle has been tightened, such as illustrated above in FIG. 3A.

Figure 9A:
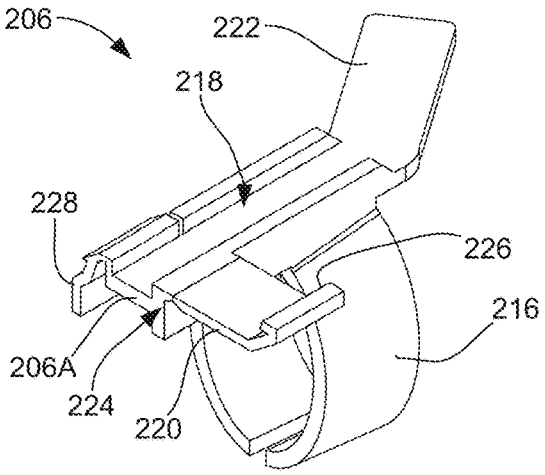
FIGS. 9A and 9B show a finger engagement structure (thumb tool) of the assembly of FIGS. 8A-8B.
Figure 9B:
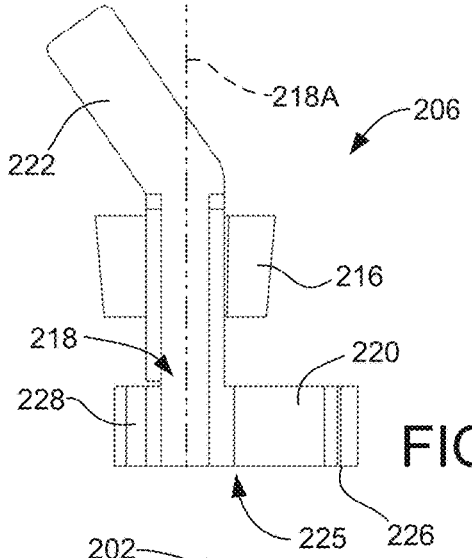

FIGS. 9A and 9B show the thumb tool 206 to include a tapered thumb ring 216, a cable guide channel 218, a securement clip 220 and an extension flange 222. A central alignment axis of the cable guide channel 218 is denoted at 218A.

Figure 10A:
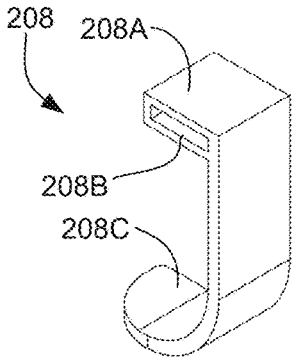
FIGS. 10A, 10B and 10C show attachment of a thumb tool adjuster to the thumb tool of FIGS. 9A-9B.
Figure 10B:
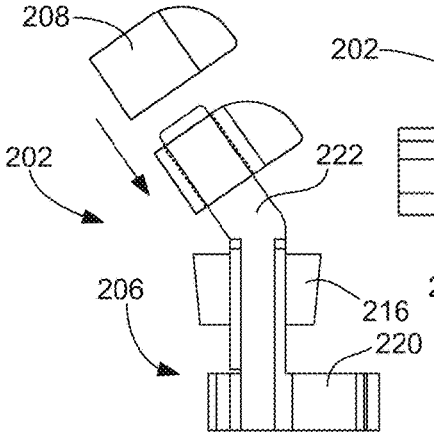
Figure 10C:
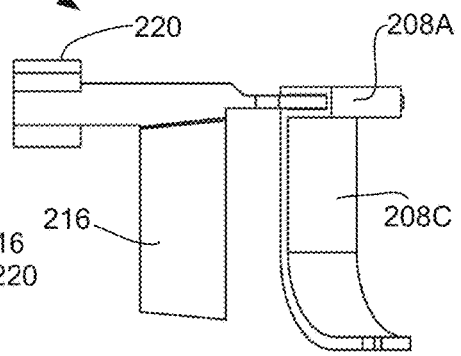

As shown in FIGS. 10A-10B, the thumb adjuster 208 includes a base housing 208A with an interior rectangular channel 208B to accommodate the extension flange 222. A support flange 208C extends downwardly from the base housing 208A with a curvilinearly extending support surface. To attach the thumb adjustor 208, the base housing 208A is slidingly placed onto the extension flange 222, and the position of the thumb adjustor is adjusted to support the base of the user's thumb 209A (see FIG. 8B).

Figure 11A:
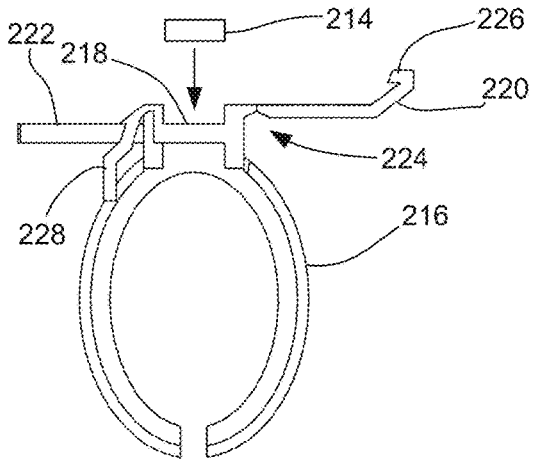
FIGS. 11A and 11B show a hinge assembly of the thumb tool.
Figure 11B:
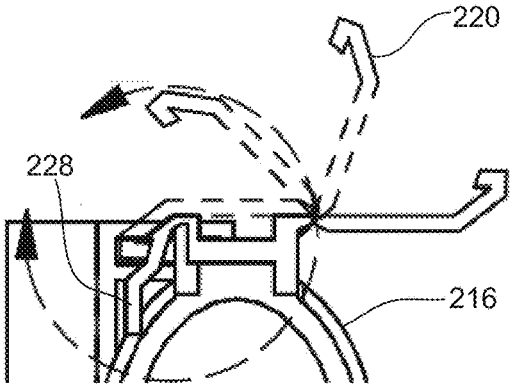

As best viewed in FIGS. 11A and 11B, the securement clip 220 includes a living hinge 224 with a retention tab 226. To secure the head 212 of the cable tie 210, the user inserts the strap portion 214 into the channel 218 along the channel axis 218A (FIG. 9B). Once placed, the user rotates the clip 220 and snaps the clip into place, thereby securing the cable tie strap 214 from movement in either forward or backwards directions. A release flange 228 can be lifted by the user to subsequently release the clip 220 and remove the thumb tool 202 from the cable tie 210. Other head securement arrangements can be used.

It is contemplated that the user will secure the base of the strap portion 214 adjacent the head 212, as shown in FIG. 8B, so that the head is maintained near the tip of the thumb 209A of the user. A forward facing limit surface 206A (see FIG. 9A) of the thumb tool 206 can be used to contactingly align and abut a side surface of the head 212. This arrangement provides multi-point contact and support surfaces for different orthogonal surfaces of the cable tie to further stabilize and secure the cable tie 210. The specific surfaces will be selected to not interfere with the installation process and allow subsequent disengagement of the thumb tool from the completed bundle.

Figure 12A:
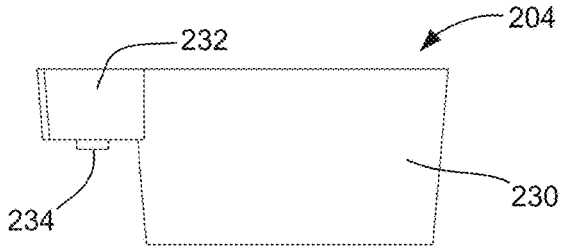
FIGS. 12A and 12B show another finger engagement structure (finger tool) of the assembly of FIGS. 8A and 8B.
Figure 12B:
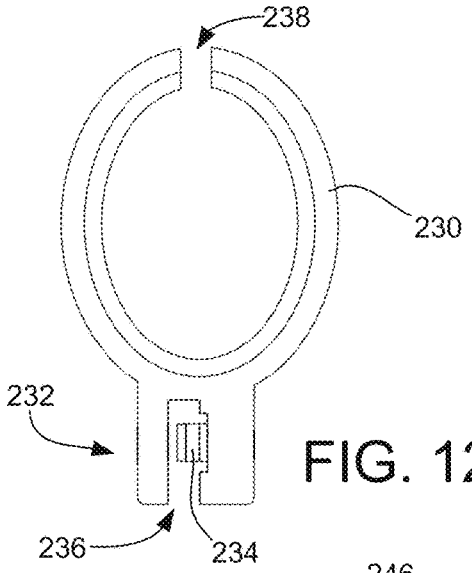

FIGS. 12A and 12B show side and top plan views of the finger tool 204 from FIGS. 8A-8B. The finger tool 204 includes a tapered finger ring 230 to accommodate the distal tip of the user's index finger 209B (see FIG. 8B). A ratcheting element in the form of a head portion 232 extends from an outer side surface of the ring 230. As with the ring 170 in FIG. 7A, the head portion 232 includes an internal pawl 234 to selectively engage the ratchet pattern of the strap portion 214. A side opening 236 in the head portion 232 allows the finger ring 230 to be slidingly engaged onto and disengaged from the strap portion. As desired, a gap opening 238 is provided in the ring 230 to accommodate different finger sizes for different users.

Figure 13A:
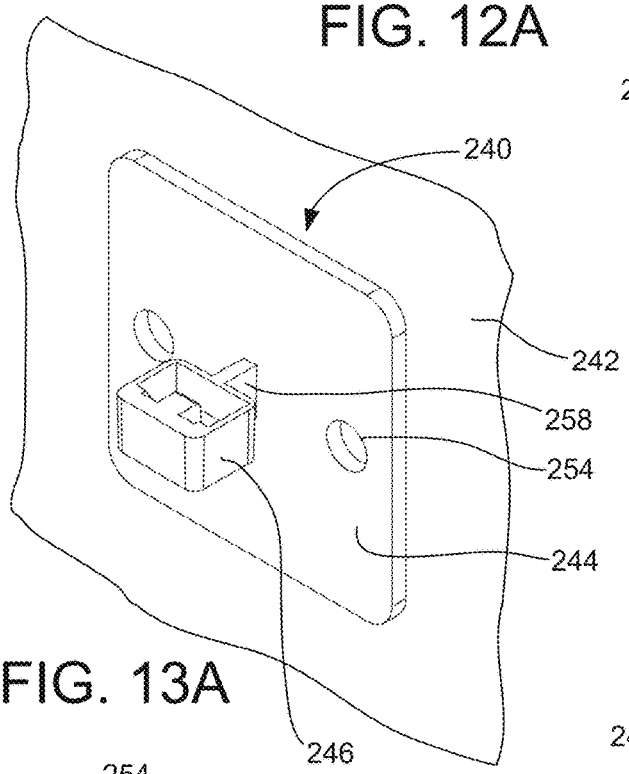
FIGS. 13A through 13E show another finger engagement structure with an integrated head portion in accordance with further embodiments.

FIG. 13A shows another finger engagement structure 240 constructed and operated in accordance with further embodiments. The structure 240 generally takes the form of a plate and is suitable for attachment to a substrate 242, such as a wall, cabinet, etc. As such, the structure 240 is also sometimes referred to as a wall mount unit.

Figure 13B:
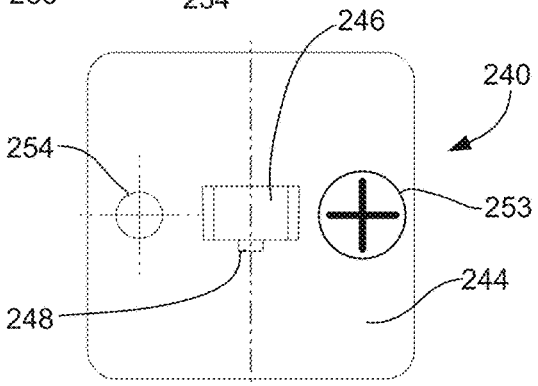
Figure 13D:
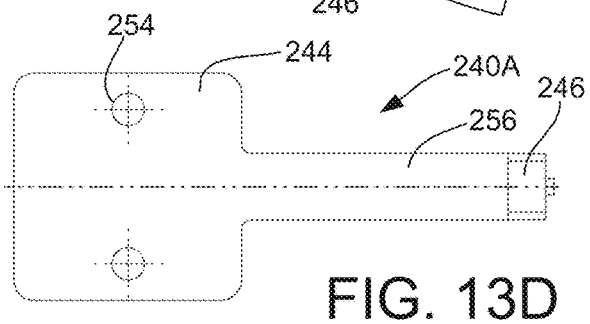
Figure 13C:
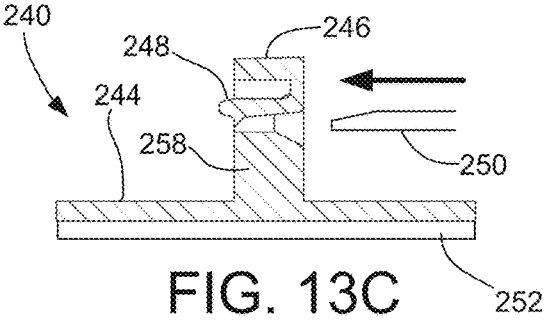

As further shown in FIGS. 13B and 13C, the wall mount unit 240 includes a planar base portion, or base plate 244. The base plate 244 is substantially rectangular in shape, although other form factors can be used. Extending from the base plate 244 is a ratcheting element in the form of a ratcheting head 246 with an internal pawl 248 configured to engage the ratcheting pattern of a cable tie 250 (see FIG.

13C). The base plate 244 is sized and shaped to be engaged by one or more fingers of the user, so that the wall mount unit 240 can be used in a manner similar to the various embodiments described above as a finger engagement structure to tighten a cable tie strap.

The base plate 242 further accommodates an attachment mechanism to enable the unit 240 to be affixed to a substrate such as 242. FIG. 13C shows one attachment mechanism in the form of an adhesive layer 252, such as double-sided tape with a backing layer, provisioned on an underside of the base plate 244. Once the cable tie has been tightened around a bundle, the backing layer can be peeled off and the wall mount unit 244 can be adhered to the substrate 242 using the adhesive layer 252.

Another attachment mechanism can take the form of one or more threaded fasteners, such as depicted at 253 in FIG. 13B. The fastener(s) 253 can be inserted through one or more mounting apertures 254 that extend through the base plate 244.

Figure 13E:
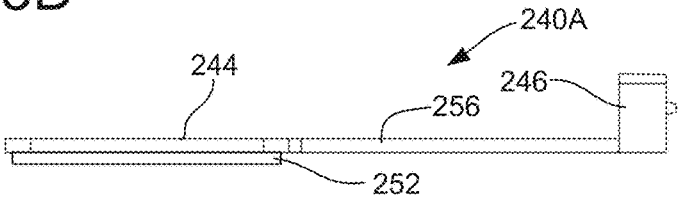

FIGS. 13D and 13E show another wall mount unit 240A similar to the unit 240 in FIGS. 13A-13C. In this case, an extension member 256 extends laterally from and in-plane with the base plate 244 to support the head 246 a substantial distance away from the base plate. Any suitable extension distance can be used (e.g., 2-3 inches, etc.).

This arrangement allows the bundle to be supported below the plate while allowing clearance space for attachment of the plate to the underlying substrate using a suitable attachment mechanism (e.g., cable 118A, adhesive 252, fasteners 253, etc.). Both units 240, 240A provide sufficient gripping surface area and contours for the user to ratchet a cable tie, regardless whether the units are subsequently used to attach the resulting bundle to a substrate. As such, the various finger engagement structures presented herein can provide ratcheting and/or securement capabilities.

Referring again to the unit 240 in FIG. 13A, the head 246 is supported by a relatively short extension member 256 in a normal direction to the base plate 244, so that the head 246 is proximate the base plate 244. In an alternative embodiment, the extension member 256 in FIG. 13A is provided with a significantly longer length so that the head 246 extends in a normal direction a significant distance away from the base plate 244 in a manner similar to the embodiment of FIGS. 13D-13E.

In an alternative application, the units 240, 240A can be affixed to an existing cable tie that has already been installed. That is, once the cable tie has been fully secured about a bundle, the head 246 can be ratcheted onto that portion of the cable tie strap that extends past the head to secure the bundle or for other purposes.

Figure 14A:
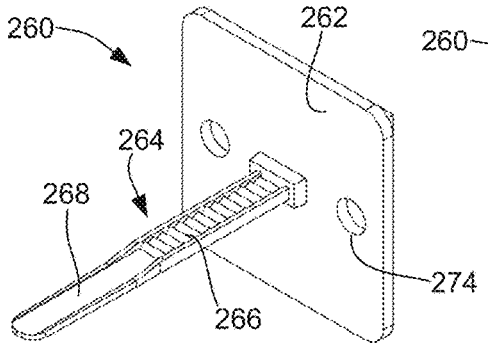
FIGS. 14A, 14B, 14C, 14D and 14E show yet another finger engagement structure with an integrated tail portion in accordance with further embodiments.
Figure 14B:
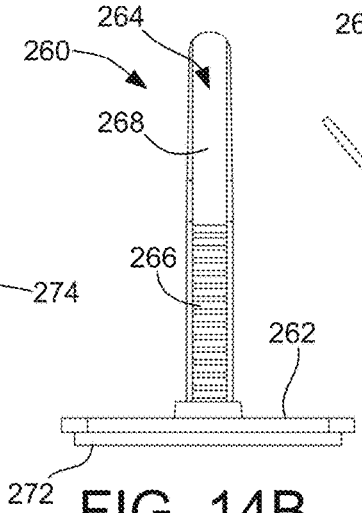
Figure 14C:
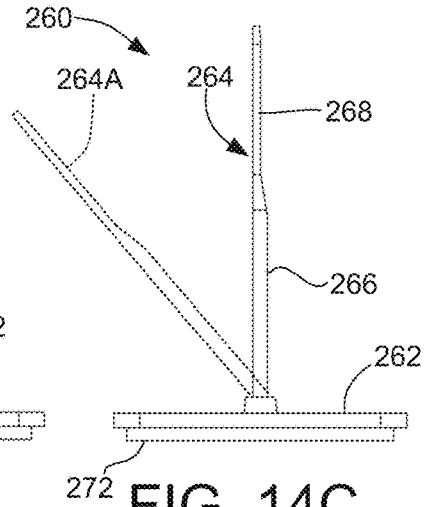

FIGS. 14A through 14C show another finger engagement structure 260 constructed and operated in accordance with further embodiments. The structure 260 is substantially similar to the units 240, 240 described above, except that the structure 260 includes a strap portion, rather than a head, of a cable tie. As before, the structure 260 can be used as a wall mount unit for a bundle.

The structure 260 includes a base plate 262 and a ratcheting element in the form of a shortened strap portion 264 that extends from the base plate having a ratchet pattern 266. A smooth tip portion 268 extends from the end of the strap portion 264 and may be thinner than the ratchet portion to facilitate threading of the strap. Other arrangements can be used, including lengths of ratcheting patterns and tip portions that are longer or shorter than those shown in the drawings.

As before, an attachment mechanism can be used to secure the base plate 262 to a substrate, such as via an adhesive layer 272 or the use of threaded fasteners (such as 253 in FIG. 13B) through mounting apertures 274.

Figure 14D:
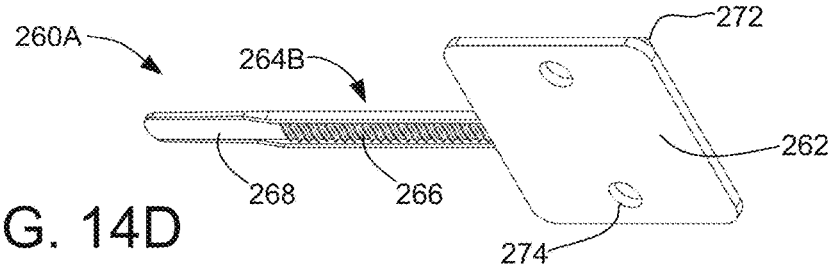
Figure 14E:
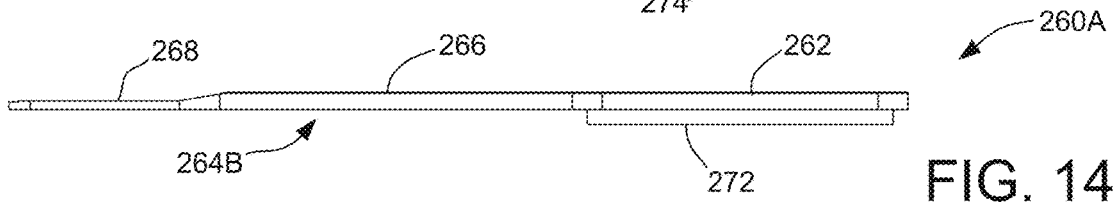

The strap portion 264 can extend in a normal direction to the base plate 262 as depicted in FIGS. 14A-14C, or can extend at any other desired angle, such as nominally 45 degrees as shown by alternative strap portion 264A in FIG. 14C. The strap portion can also extend in a planar direction, as shown in FIGS. 14D-14E for finger engagement structure 260A. The structure 260A has a strap portion 264B which extends in plane with the base plate 262, as with the in-plane embodiment of FIGS. 13D-13E.

Figure 15A:
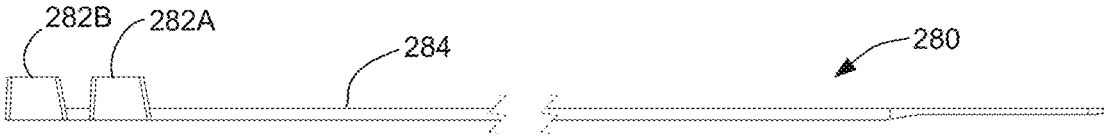
FIGS. 15A and 15B show a cable tie with multiple head portions to engage the structures of FIGS. 14A-14E.
Figure 15B:
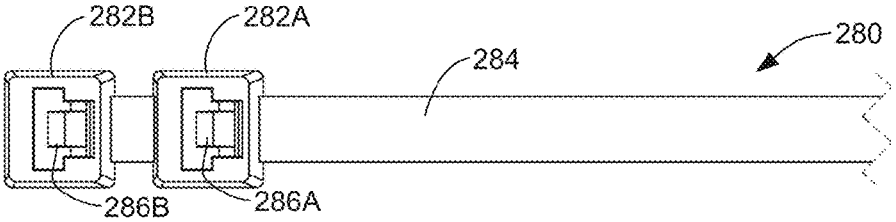

Because the finger engagement structures 260, 260A do not directly incorporate a head, these structures cannot normally be used to tighten a cable tie during installation in the manner described above for the previously discussed embodiments. However, the structures can be used for securement purposes, particularly when used in conjunction with a specially configured, two-headed cable tie 280 as shown in FIGS. 15A-15B.

The cable tie 280 includes first and second heads 282A, 282B and strap portion 284. The respective heads 282A, 282B have internal pawls 286A, 286B. In some embodiments, the cable tie 280 is configured to facilitate securement of a bundle through threaded engagement of the strap portion 284 through the first (primary) head 282A. Once secured, the second head 282B can be used to receivingly engage the strap portion 264, 264A, 264B of the respective mounting structures 260, 260A, thereby allowing the bundle to be mounted to a substrate or other mounting location as before.

FIGS. 16A through 16E show a number of different cable bundle mounting arrangements that can be implemented using the various embodiments described herein. It will be appreciated that other arrangements can be used, so that these are merely for purposes of illustration and are not limiting.

Figure 16A:
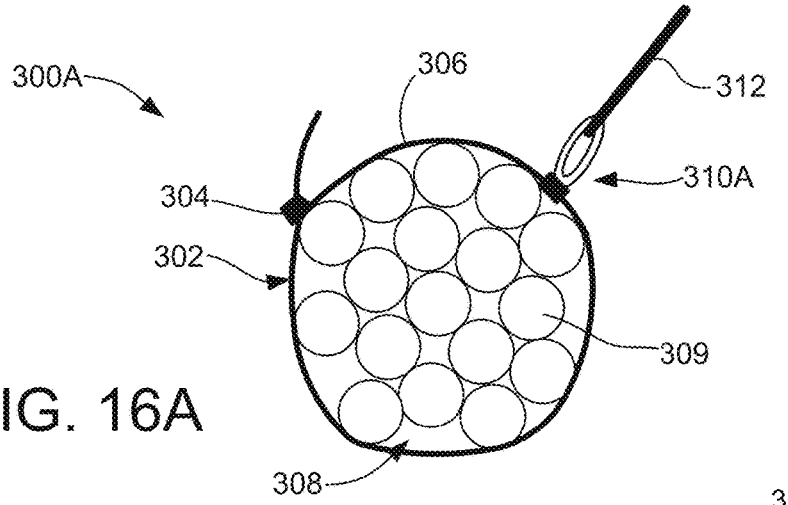
FIGS. 16A, 16B, 16C, 16D and 16E show various bundle securement configurations that can be obtained using the various embodiments of FIGS. 1-15B.

FIG. 16A shows a first arrangement 300A, in which a cable tie 302 having a ratcheting head 304 and strap 306 has been secured about a bundle 308. In this case, the bundle 308 is contemplated as comprising a plurality of conductive wires 309, but this is merely for purposes of illustration. Other bundles are contemplated, including bundles that incorporate a single item or element.

A finger engagement structure 310A has been used as part of the securement process. In this case, the structure 310A is similar to the ring structure 110 discussed above in FIG. 3A, and includes a ring and head arrangement that was used to facilitate the final securement of the cable tie 302 around the bundle.

An attachment mechanism in the form of a flexible cord 312 is attached to the ring structure 310, thereby securing the bundle to an appropriate mounting substrate (not shown in FIG. 16A). Use of the ring structures such as 310A for attachment is not required, but can be performed as desired.

Figure 16B:
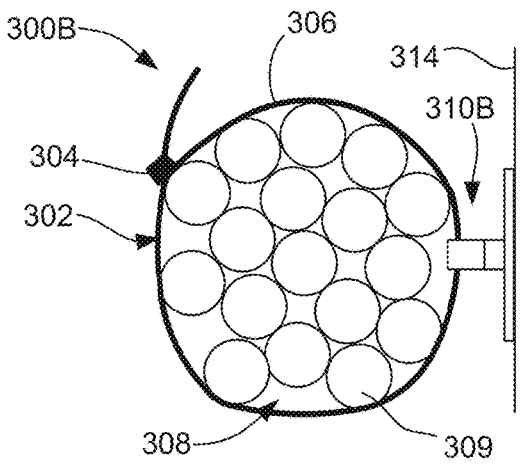

FIG. 16B shows a second arrangement 300B using the same cable tie 302 and bundle 308 from FIG. 16A. In this case, a finger engagement structure 310B takes the form of a wall mount unit similar to the structure 240 in FIGS. 13A-13C. As such, the structure 310B includes a head that engages the strap 306 of the cable tie 302 and a base plate that mounts the bundle 308 to a substrate 314 (in this case, a vertical wall surface).

A suitable attachment mechanism such as adhesive and/or threaded screws (not separately shown) secures the structure 310B to the substrate 314. It will be appreciated that the actual orientation of the bundle 308 relative to the substrate 314 will depend on a number of factors, so the cantilevered support orientation shown in FIG. 16B for the bundle 308 is not necessarily limiting.

Figure 16C:
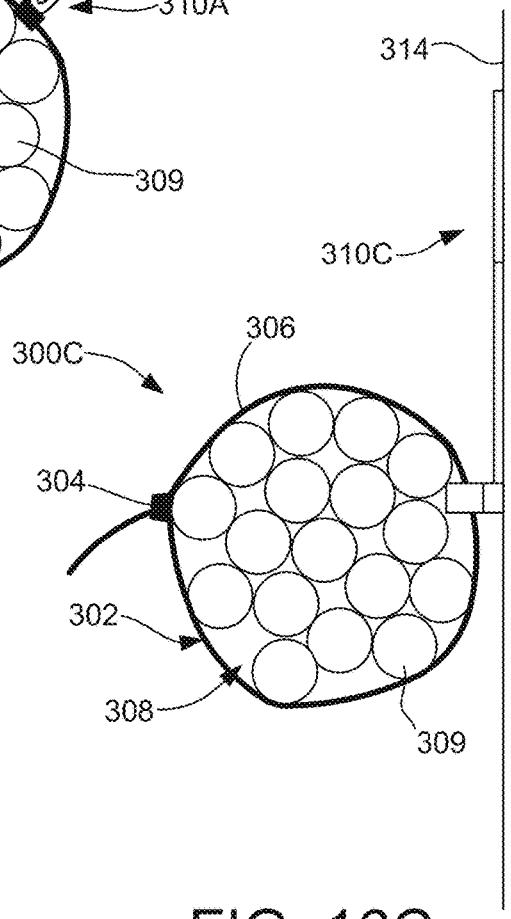

FIG. 16C shows a third arrangement 300C using the same cable tie 302 and bundle 308 as before. In this case, a finger engagement structure 310C takes the form of a wall mount unit similar to the structure 240A in FIGS. 13D-13E. A suitable attachment mechanism secures the structure 310C and bundle 308 to the substrate 314.

Figure 16D:
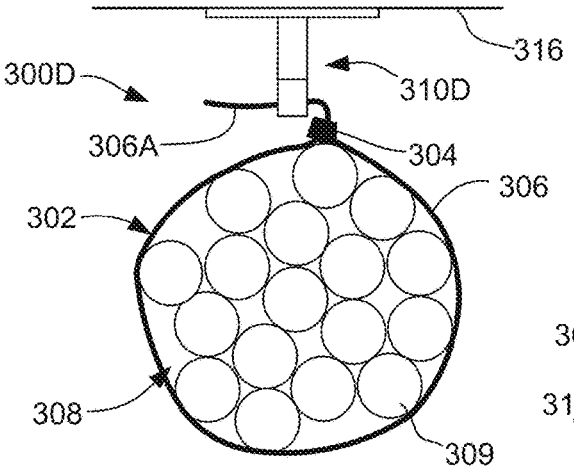

FIG. 16D shows a fourth arrangement 300D using the same cable tie 302 and bundle 308 as before. A finger engagement structure 310D is similar to the wall mount unit 310B in FIG. 16B, except that the structure 310D has a longer head extension member (see e.g., element 258, FIG. 13A).

In FIG. 16D, the head portion of the structure 310D has engaged the ratcheting pattern in a portion 306A of the strap 306 that extends past the cable tie head 304. It follows that the structure 310D was not used during the tightening of the cable tie 302 about the bundle 308, but has been subsequently used to secure the tightened bundle to a substrate 316.

The substrate 316 is an overhead, horizontal support surface such as a ceiling or an interior of a cabinet; however, this is merely to illustrate that the various examples can be mounted to substrates and other mounting locations having any number of different orientations, including vertical, horizontal, overhead, underneath, adjacent, etc. as required.

Figure 16E:
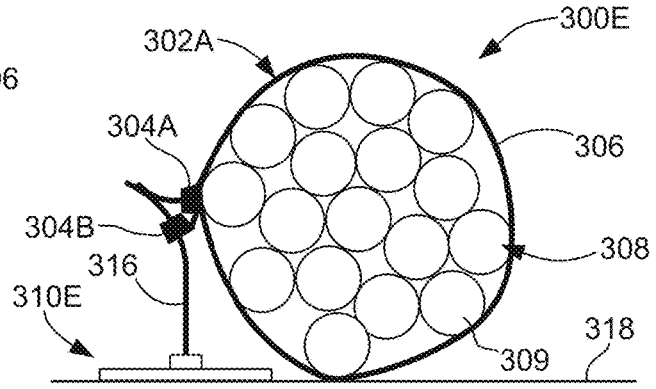

FIG. 16E provides yet another mounting arrangement 300E. In this case, a two-headed cable tie 302A has been used similar to the cable tie 280 in FIGS. 15A-15B. The cable tie 302A has primary and secondary heads 304A, 304B. A strap portion 306 of the cable tie 302A has been fed through the primary head 304A to secure the bundle 308 as before.

A finger engagement structure 310E takes a general form similar to the structures 260, 260A in FIGS. 14A-14E, and includes a strap portion 316 that engages the secondary head 304B. The structure 310E secures the bundle 308 to an underlying substrate 318.

Figure 17:
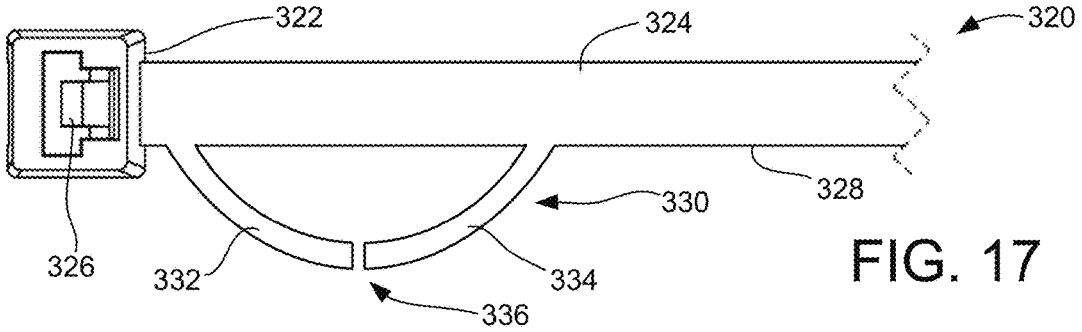
FIG. 17 shows another cable tie with an integrated finger engagement structure.

FIG. 17 shows another specially configured cable tie 320 in accordance with further embodiments. The cable tie 320 includes a head 322 and strap portion 324. As before, the strap portion 324 has a ratchet pattern (not shown) that engages a pawl 326 of the head 322.

The cable tie 320 further includes an integrated finger engagement structure 330 in the form of a thumb ring that extends from a side surface 328 of the strap portion 324. The thumb ring 330 includes a pair of curvilinearly extending members 332, 334 sized to permit insertion of the user's thumb (119A, 209A) to secure the head 322. An intervening gap 336 between the members 332, 334 provides flexibility and adjustability for different user applications.

As desired, a finger ring/tool such as 110, 204 can be used on the user's index finger (119B, 209B) to tighten the strap portion 324, or the thumb ring 330 can be used alone without an additional structure to facilitate placement of the cable tie.

Figure 18A:
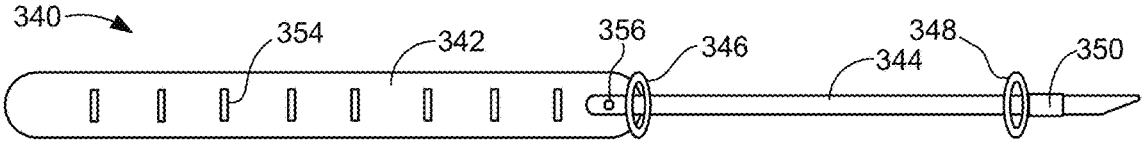
FIGS. 18A, 18B and 18C shows another cable tie installation assembly having a stainless steel, spring metal construction.
Figure 18B:
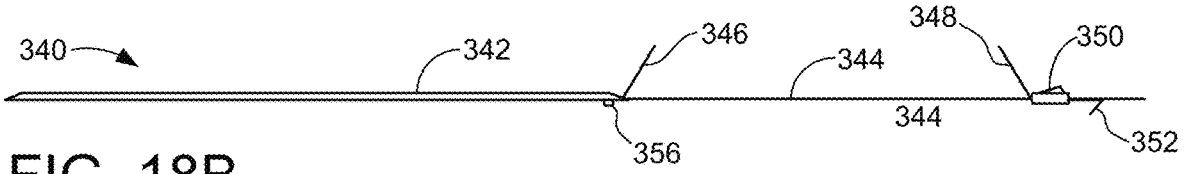

FIGS. 18A and 18B show another cable tie installation assembly 340 having a stainless steel, spring metal construction. The cable tie includes a slotted strap portion 342, a zip strap portion 344, a fixed thumb ring 346, a moveable finger ring 348, and a ratcheting element in the form of a zip hook assembly 350 with a metal retention hook 352. The strap portion 342 includes a sequence of spaced apart slots 354. A fastener 356, such as a rivet, can be used to connect the respective straps 342, 344.

The slotted strap portion 342 is formed of shape memory metal with a normally straight orientation as shown in FIGS. 18A-18B until force is supplied to the strap from below, at which point the shape memory metal will induce curvature of the strap 342 about the adjacent bundle. The rings 346, 348 serve as finger engagement structures to facilitate installation as before.

To install the assembly 340, the user manipulates the assembly using the respective rings 346 and 348, inserts the hook 352 into the farthest accessible slot 354, and then engages the zip hook assembly 350 to tighten. In some embodiments, the rings can be folded up for use and then folded down flush with the strap 344, or used as securement points as before.

Figure 18C:
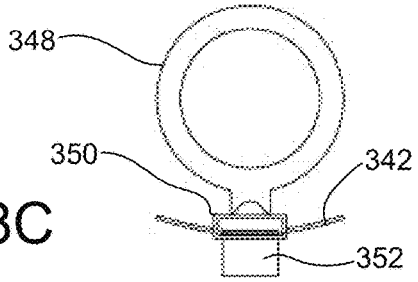

FIG. 18C shows an end view of the assembly 340 including the finger ring 348, zip hook assembly 350 and hook 352. Any suitable strap lengths can be provided as required.

Figure 19A:
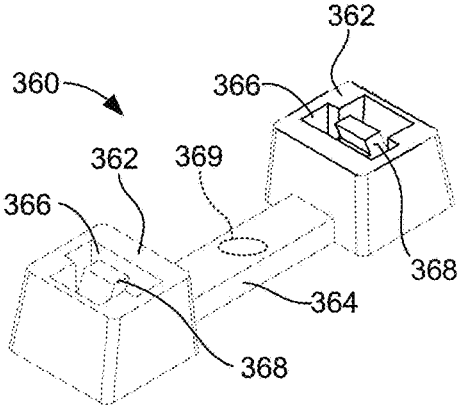
FIGS. 19A and 19B show a cable tie installation assembly having a dual headed construction.
Figure 19B:
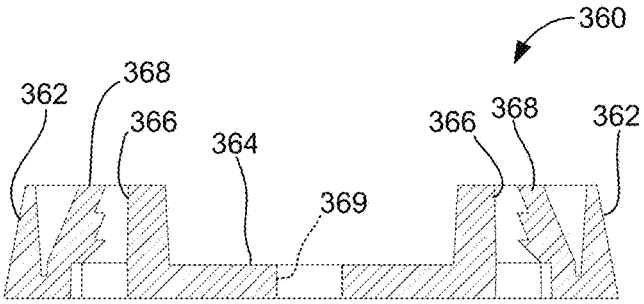

FIGS. 19A and 19B show yet another cable tie installation assembly 360 in accordance with further embodiments. The assembly 360 provides a dual-headed finger engagement structure having first and second heads 362 separated by an intervening interconnection member 364. The heads 362 constitute ratcheting elements with channels 366 that enclose deflectable pawls 368 to engage separate cable ties. An optional through hole aperture 369 can be provided to facilitate attachment to a substrate or other mounting location.

The assembly 360 can be formed from a single piece of material or from multiple adjoined pieces of material. Suitable materials can include plastics, nylon, metal, etc. as before. The interconnection member 364 can be flexible or rigid, and can be any desired length, width and/or shape. The interconnection member 364 does not include a ratcheting element such as a ratcheting pattern, and may be textured or smooth as required. Other configurations for the member 364 can be used as well, including embodiments with rings, plates, etc.

Figure 20A:
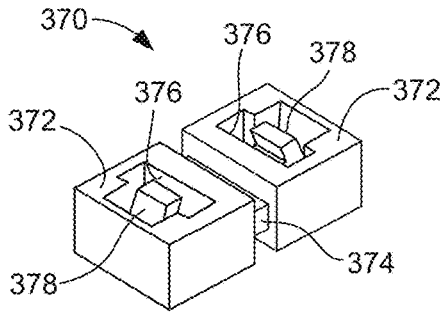
FIGS. 20A, 20B and 20C show another cable tie installation assembly having a dual headed construction.
Figure 20B:
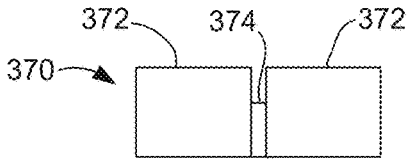

FIGS. 20A and 20B show another cable tie installation assembly 370 similar to the assembly 360 in FIGS. 19A-19B. The assembly 370 also provides a dual-headed finger engagement structure with first and second ratcheting heads 372. In this case, the heads 372 may be directly adjoined or be separated by a relatively short interconnection member 374, as before. The heads 372 include channels 376 with interior pawls 378 to serve as ratcheting elements upon two separate cable ties.

Figure 20C:
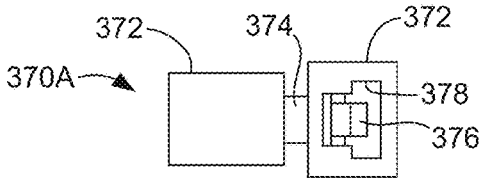

FIG. 20C shows another assembly 370A with different respective orientations of the heads 372. Suitable lengths for the interconnection members 364, 374 can include from about 0.5 inches, in. or less to upwards of 6 in. or more. Other lengths and configurations can be used as required.

Figure 21A:
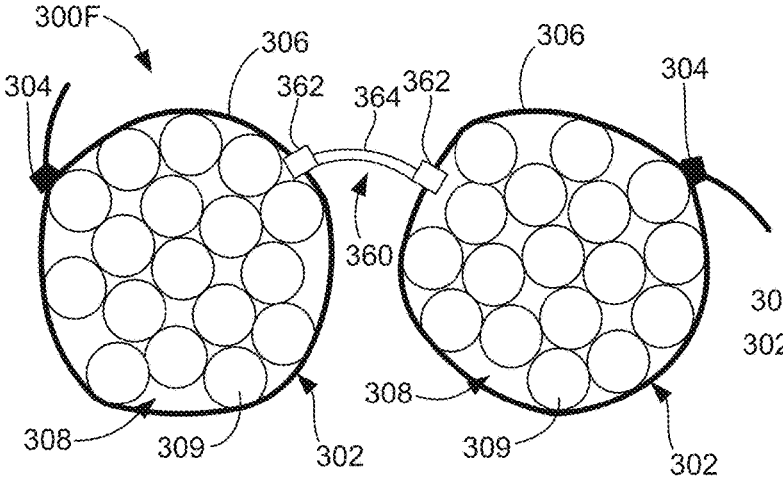
FIGS. 21A and 21B show various bundle securement configurations that can be obtained using the embodiments of FIGS. 19A-19B and 20A-20C.

FIG. 21A shows an exemplary mounting arrangement 300F using the assembly 360 from FIGS. 19A-19B to secure a pair of bundles 308 similar to those discussed above in FIGS. 16A-16E. The respective heads 362 of the assembly are ratcheted onto and used to tighten and secure the respective cable ties 302 as shown. Other arrangements can be used, including an arrangement where the intervening member 364 is secured to a substrate or other mounting location.

Figure 21B:
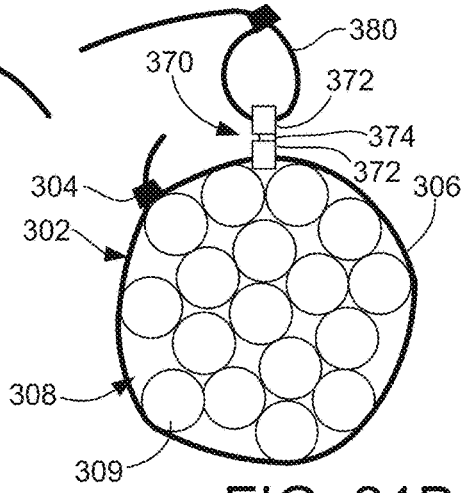

FIG. 21B shows another exemplary mounting arrangement 300G using the assembly 370 from FIGS. 20A-20B. In this case, the heads 372 of the assembly 370 are respectively ratcheted onto a cable tie 302 around bundle 308 and a separate cable tie 380 which, in turn, may be secured around another bundle, a hook, or some other attachment mechanism or location.

Figure 22:
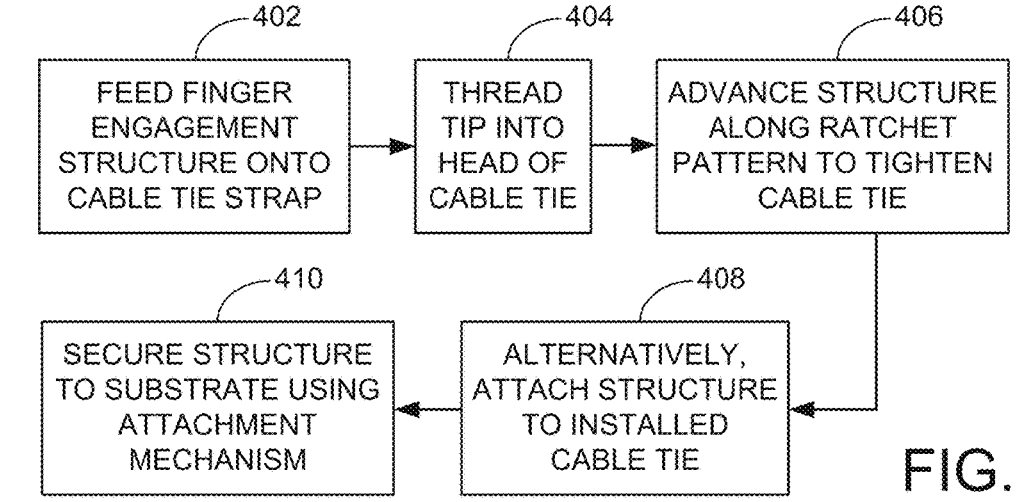
FIG. 22 is a sequence diagram illustrative of steps that can be carried out to use a cable tie installation assembly as variously embodied herein.

FIG. 22 is a sequence diagram 400 to illustrate steps that can be variously carried out during the installation of a cable tie in accordance with the foregoing discussion. It will be appreciated that the various steps in FIG. 22 may be omitted, performed in a different order, etc. depending on the type of application.

Block 402 depicts the feeding of a finger engagement structure onto a cable tie strap. This can be carried out including by providing a structure with a ratcheting head portion adapted to zip along the ratchet pattern of the cable tie, such as but not limited to the structures 110, 160, 162, 170, 204, 240, 240A, 310A-310D, 350, 360, 370 or 370A. If the structure has a side slot (e.g., 176 in FIG. 7A, 236 in FIG. 12B), the structure can be fed onto the cable tie from the side.

Block 404 depicts threading the tip of the cable tie into the head of the cable tie. This can be carried out manually, or via the use of one or more finger engagement structures including as shown in FIGS. 1C, 1D and 8B.

Block 406 depicts repetitively advancing a finger engagement structure along the ratchet pattern of the cable tie to tighten the tie as the ratchet pattern passes through the head of the cable tie. This is carried out including by the use of a finger tie/tool as various described above.

Block 408 provides an additional or alternative operation whereby a finger engagement structure is attached to a previously installed cable tie that surrounds a bundle by engaging a tail end portion of the installed cable tie that extends beyond the head portion of the cable tie. This can include the wall mount unit style structures 240, 240A, 260, 260A described above. It will be appreciated that other structures, such as the ring structures 110 and 170, and the dual-headed versions 360, 370 and 370A, can also be attached to a protruding tail end of a cable as desired.

Finally, block 410 depicts securing an attached finger engagement structure to a substrate using a suitable attachment mechanism. Examples include those set forth in FIGS. 16A-16E, as well FIGS. 3A, 13A and 21A-21B.

The various embodiments presented herein provide a number of advantages, benefits and improvements over the existing art, including the ability to efficiently and effectively install a cable tie about a bundle. Without limitation, the various embodiments can be characterized as including a finger engagement structure (such as 110, 160, 162, 170, 204, 240, 240A, 310A-310D, 350, 360, 370, 370A) comprising a ratcheting element (such as 144, 162A, 172, 232, 246, 268, 350, 362, 372) configured to ratchetingly engage a cable tie (such as 152, 210, 250, 280, 302, 320, 340), and a contact member (such as 118, 162B, 174, 230, 244, 262, 348, 364, 374) configured for engagement by a finger (such as 119B, 209B) of a user (such as 119, 209) to facilitate tightening of the cable tie and securement of a bundle (such as 308) to a substrate (such as 314, 316, 318).

The various embodiments can be efficiently utilized in a number of applications and environments including but not limited to the electronics, automotive, law enforcement, medical, residential, commercial, industrial, military, aerospace, and oil & gas industries.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the 10 broad general meaning of the terms in which the appended claims are expressed.

What is claimed is:

1. An apparatus, comprising:

a cable tie comprising a first ratcheting head and a strap having a ratcheting pattern configured to engage the first ratcheting head to encircle and secure a bundle; and a finger engagement structure comprising a ratcheting element configured to ratchetingly engage the cable tie and a contact member configured for engagement by a finger of a user to facilitate tightening of the cable tie and securement of the bundle to a substrate, wherein the ratcheting element comprises a second ratcheting head configured to engage the ratcheting pattern of the cable tie, and the contact member comprises a selected one of a ring, a plate or a third ratcheting head.

2. The apparatus of claim 1, wherein the contact member comprises a ring structure configured to accommodate insertion of an index finger of the user, and wherein the apparatus further comprises a second finger engagement structure affixed to the cable tie adjacent the ratcheting head comprising a second ring structure configured to accommodate insertion of a thumb of the user.

3. The apparatus of claim 1, wherein the contact member comprises a plate from which the ratcheting element extends and a layer of adhesive affixed to the plate to facilitate attachment of the plate to a substrate.

4. The apparatus of claim 1, wherein the finger engagement structure is a finger tool comprising a tapered finger ring structure configured for contacting insertion of an index finger of the user.

5. The apparatus of claim 4, wherein the second ratcheting head has a side opening to facilitate lateral movement of the second ratcheting head onto and off of the strap of the cable tie.

6. The apparatus of claim 4, further comprising a thumb tool comprising a tapered thumb ring structure configured for contacting insertion of a thumb of the user, and a cable guide channel with a latching mechanism to receive and secure a portion of the cable tie adjacent the ratcheting head.

7. The apparatus of claim 1, wherein the contact member comprises a third ratcheting head connected to the second ratcheting head using an interconnection member connected therebetween.

8. The apparatus of claim 7, wherein the second ratcheting head is aligned along a first orientation and the third ratcheting head is aligned along a different, second orientation orthogonal to the first orientation.

9. The apparatus of claim 1, wherein the first ratcheting head of the cable tie comprises a deflectable pawl, wherein the ratcheting pattern of the strap comprises a sequence of shoulder surfaces configured to lockingly engage the deflectable pawl, and wherein the finger engagement structure comprises only a selected one of a second deflectable pawl or a second ratcheting pattern having a second sequence of shoulder surfaces.

10. The apparatus of claim 1, wherein the finger engagement structure is affixed to an outer surface of a glove worn by the hand of the user.

11. The apparatus of claim 1, wherein the strap of the cable tie is formed of shape memory metal.

12. An apparatus, comprising:

a cable tie comprising a first ratcheting head and a first strap having a ratcheting pattern configured to engage the first ratcheting head to encircle and secure a bundle; and a finger engagement structure comprising a ratcheting element configured to ratchetingly engage the cable tie and a contact member configured for engagement by a finger of a user to facilitate tightening of the cable tie and securement of the bundle to a substrate, wherein the ratcheting element comprises a second strap having a second ratcheting pattern configured to engage a second ratcheting head of the cable tie, and the contact member comprises a plate from which the second strap extends.

13. The apparatus of claim 12, wherein the contact member further comprises at least a selected one of a layer of adhesive or a through hole to accommodate a threaded fastener for attachment of the plate to a substrate.

14. An apparatus, comprising:

a cable tie comprising a first ratcheting head and a strap having a ratcheting pattern configured to engage the first ratcheting head to encircle and secure a bundle; and a finger tool comprising a second ratcheting head configured to ratchetingly engage the strap of the cable tie and a finger ring structure configured for engagement of an index finger of a user to facilitate tightening of the cable tie.

15. The apparatus of claim 14, wherein the second ratcheting head has a side opening to facilitate lateral movement of the second ratcheting head onto and off of the strap of the cable tie.

16. The apparatus of claim 14, further comprising a thumb tool comprising a thumb ring structure configured for contacting insertion of a thumb of the user.

17. The apparatus of claim 16, wherein the thumb tool further comprises a cable guide channel with a latching mechanism to receive and secure a portion of the cable tie adjacent the first ratcheting head.

18. The apparatus of claim 16, further comprising a glove configured to be worn by a hand of the user, wherein the finger tool and the thumb tool are each affixed to the glove.

19. The apparatus of claim 14, wherein the strap of the cable tie is formed of metal.

20. An apparatus, comprising:

a cable tie comprising a first ratcheting head and a strap having a ratcheting pattern configured to engage the first ratcheting head to encircle and secure a bundle;

a first finger engagement structure comprising a ratcheting element configured to ratchetingly engage the cable tie and a contact member to facilitate tightening of the cable tie and securement of the bundle to a substrate, wherein the contact member comprises a first ring structure configured to accommodate insertion of an index finger of the user and the ratcheting element comprises a second ratcheting head; and a second finger engagement structure affixed to the cable tie adjacent the first ratcheting head comprising a second ring structure configured to accommodate insertion of a thumb of the user.

21. The apparatus of claim 20, wherein the cable tie, the first finger engagement structure and the second finger engagement structure are each formed of metal.

22. The apparatus of claim 20, wherein the strap of the cable tie is formed of shape memory metal.

* * * * *